US007255337B2

(12) United States Patent
Wakabayashi et al.

(10) Patent No.: US 7,255,337 B2
(45) Date of Patent: Aug. 14, 2007

(54) OSCILLATING TRANSPORT UNIT FOR POST-PROCESSING DEVICE

(75) Inventors: Hiroyuki Wakabayashi, Hachioji (JP); Toshio Shida, Higashiyamato (JP); Masaaki Uchiyama, Hachioji (JP); Masato Hattori, Hino (JP); Kenji Kawatsu, Machida (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 273 days.

(21) Appl. No.: 10/893,952

(22) Filed: Jul. 20, 2004

(65) Prior Publication Data

US 2005/0073082 A1 Apr. 7, 2005

(30) Foreign Application Priority Data

Oct. 1, 2003 (JP) ..... 2003-342927

(51) Int. Cl.
*B65H 37/04* (2006.01)

(52) U.S. Cl. ..... 270/37; 270/58.07; 270/58.08; 270/52.17; 270/32; 412/16; 83/934; 83/437.1; 83/411.4; 83/401

(58) Field of Classification Search ..... 270/58.07, 270/58.08, 52.17, 32, 37; 412/16; 83/934, 83/437.1, 411.4, 401
See application file for complete search history.

(56) References Cited

U.S. PATENT DOCUMENTS 4,473,425 A * 9/1984 Baughman et al. ..... 156/356
4,592,651 A * 6/1986 Oikawa et al. ..... 355/72
4,611,741 A * 9/1986 Wilson ..... 227/99
5,029,831 A * 7/1991 Green ..... 270/58.08
5,964,459 A * 10/1999 Yamanaka ..... 270/58.08
6,575,447 B2 6/2003 Yoshie et al.
6,929,256 B2 * 8/2005 Kawatsu et al. ..... 270/37
2001/0019191 A1 9/2001 Yoshie et al.
2001/0054342 A1 * 12/2001 Kato et al. ..... 83/78
2004/0096253 A1 * 5/2004 Ueno et al. ..... 399/385

FOREIGN PATENT DOCUMENTS

JP 2001-240288 9/2001
JP 2001-240296 9/2001
JP 2003292230 A * 10/2003

* cited by examiner

*Primary Examiner*—Gene O. Crawford
*Assistant Examiner*—Leslie A. Nicholson, III
(74) *Attorney, Agent, or Firm*—Finnegan, Henderson, Farabow, Garrett & Dunner, L.L.P.

(57) ABSTRACT

A post processing apparatus for processing image-recorded sheets, having: a transporting unit for transporting a booklet comprising a plurality of image-recorded sheets; a trimming section for trimming the booklet; and an oscillating mechanism for oscillating the transporting unit to change a transporting plane angle of the transporting unit; wherein, the oscillating mechanism oscillates the transporting unit to arrange a first transporting plane angle at the time when the transporting unit receives the booklet and a second transporting plane angle at the time when the transporting unit conveys the booklet to the trimming section different from each other.

13 Claims, 26 Drawing Sheets

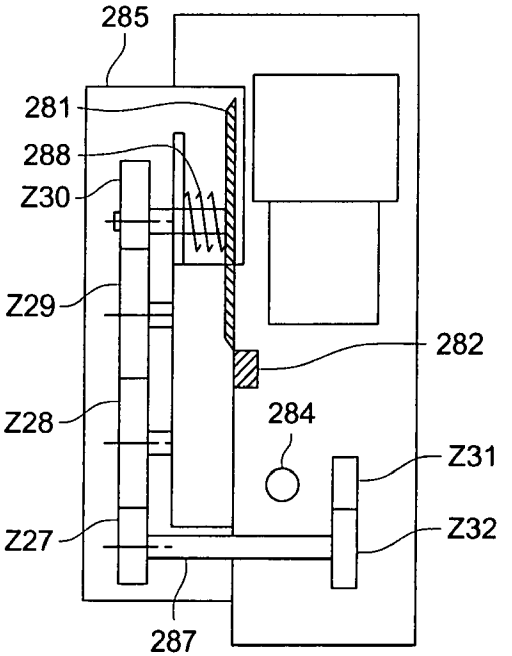
FIG. 12 ( b )
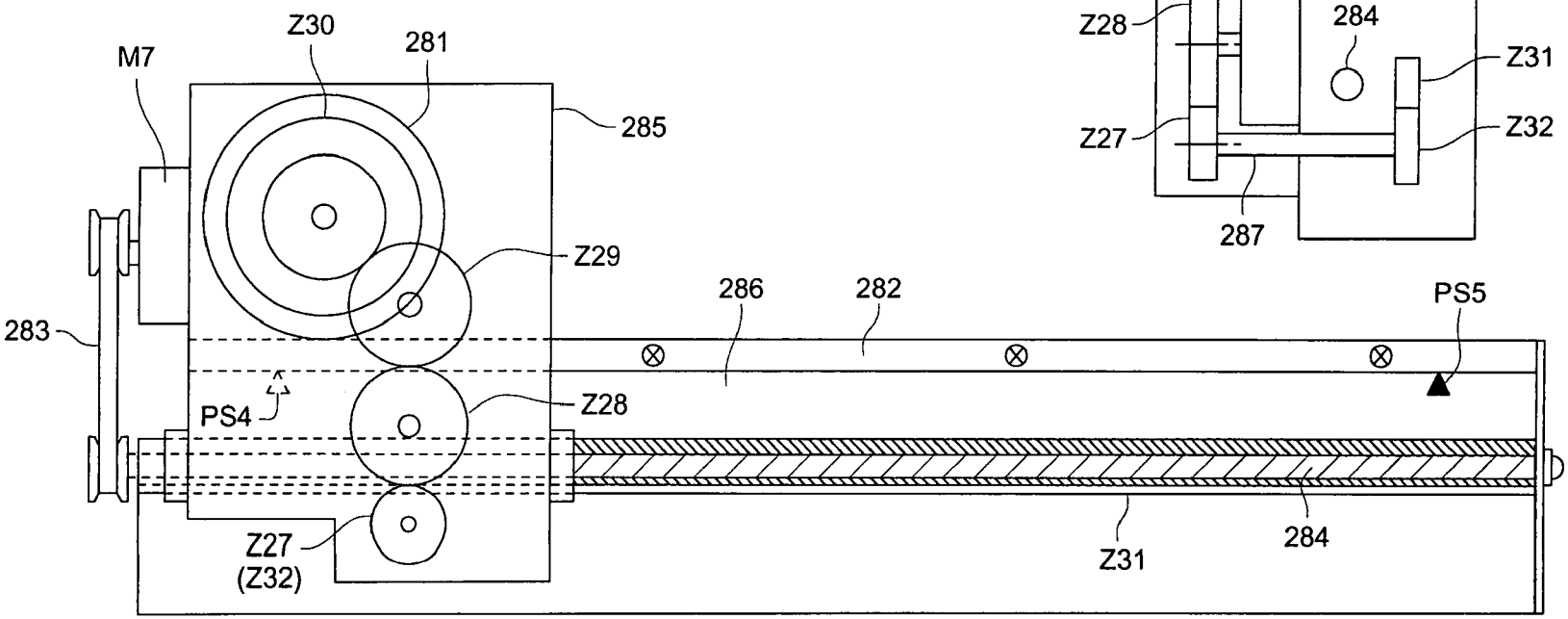
FIG. 12 ( a )

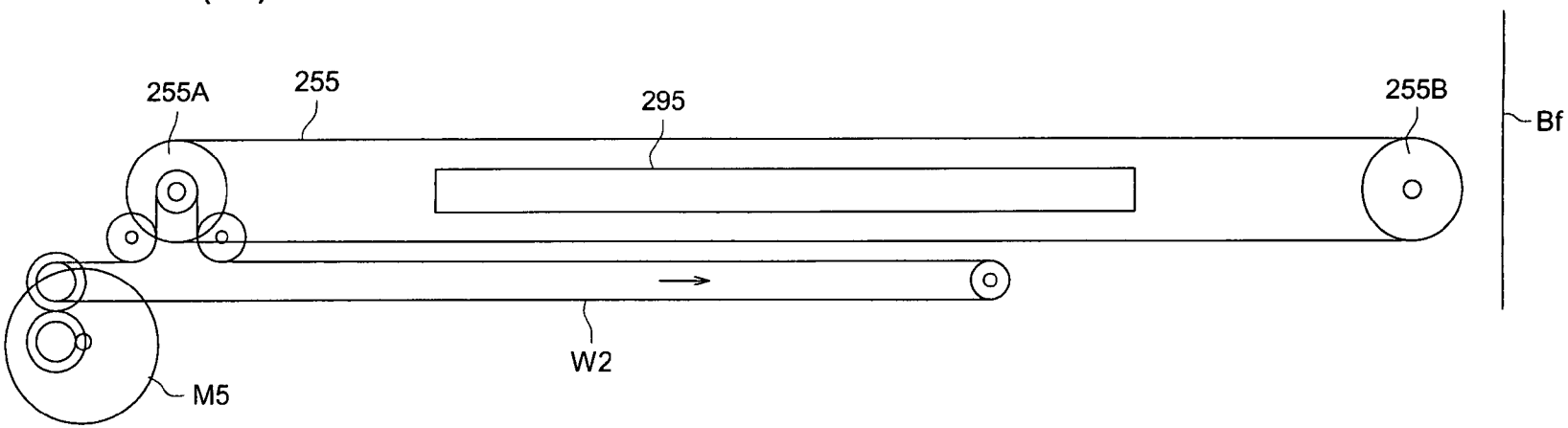
FIG. 25 ( a )
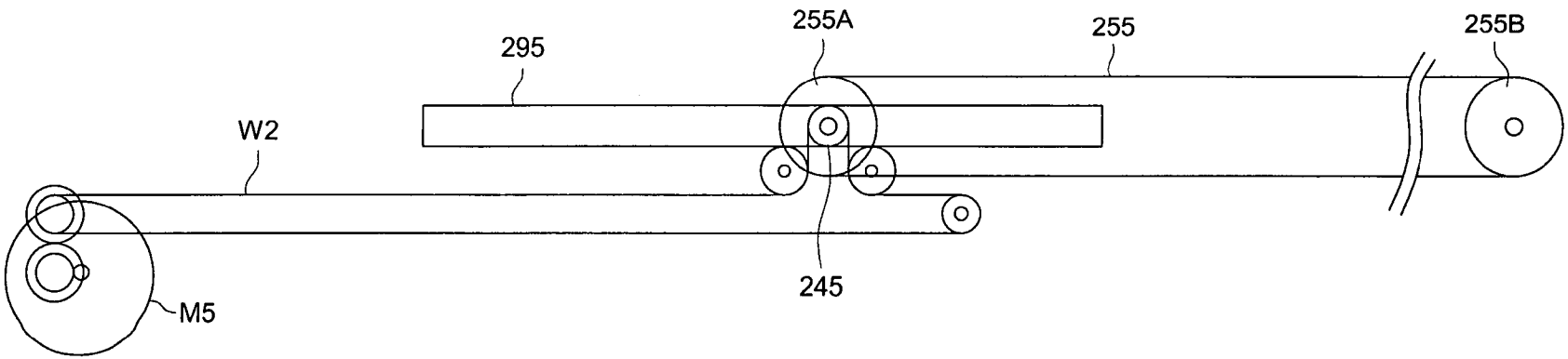
FIG. 25 ( b )

OSCILLATING TRANSPORT UNIT FOR POST-PROCESSING DEVICE

BACKGROUND OF THE INVENTION

The present invention relates to a post-processing apparatus for trimming the edge of the center-folded and saddle-stitched sheets on which images outputted from an image-forming apparatus have been recorded, and also relates to an image-forming system comprising the aforementioned post-processing apparatus.

Conventionally, the printing industry has achieved the practical use of a post-processing apparatus comprising a trimming apparatus for trimming the edge of a booklet which has been saddle-stitched and center-folded.

Also recently, there has been presented a post-processing apparatus, incorporating a trimming apparatus, which saddle-stitches and center-folds the sheets having images created by an image-forming apparatus, such as a copier, printer, etc., in order to bind them as a booklet like a weekly magazine, and then trims the edge of the booklet by means of the built-in trimming apparatus to neatly align the edge.

A trimming apparatus disclosed in patent document 1 comprises a lower transporting belt for transporting a saddle-stitched and center-folded booklet, a contact-pressing means for contact-pressing the upper surface of the booklet loaded on the lower transporting belt, a lifting means for lifting the contact-pressing means, and a drive means for driving the lifting means, wherein the lifting means and the drive means are located below the lower transporting belt.

A trimming apparatus disclosed in patent document 2 has a booklet storing means which stores a plurality of booklets that have been trimmed, wherein the booklets are held with the folds face up and their sheets pressed against one another.

[Patent Document 1] Official Gazette of Japanese Patent Tokkai 2001-240296

[Patent Document 2] Official Gazette of Japanese Patent Tokkai 2001-240288

As shown in patent documents 1 and 2, in the conventional trimming apparatus, a saddle-stitched and center-folded booklet is transported by a rotating transporting belt, inserted into a trimmer portion of the trimming means with the booklet's fold leading, stops at a prescribed location when the leading edge of the booklet abuts against a stopper protruding into a booklet transporting passage, and then the booklet's trailing edge in the transporting direction is trimmed by a trimming means while the booklet is contact-pressed by a contact-pressing means that can be lifted.

In any of these conventional post-processing apparatus and trimming apparatus, a transporting path to transport the sheets is fixedly arranged with respect to the apparatus. Therefore, there is only a small degree of freedom for an arrangement of each processing unit, and this results in large size of the apparatus.

The present invention provides a post-processing apparatus having a large degree of freedom for arranging each processing unit in the apparatus.

SUMMARY OF THE INVENTION

The above objectives can be achieved by the following configuration:

(1). A post-processing apparatus for processing image-recorded sheets, including: a transporting unit for transporting a booklet comprising a plurality of image-recorded sheets; a trimming section for trimming the booklet; and an oscillating mechanism for oscillating the transporting unit to change a transporting plane angle of the transporting unit; wherein, the oscillating mechanism oscillates the transporting unit to arrange a first transporting plane angle at the time when the transporting unit receives the booklet and a second transporting plane angle at the time when the transporting unit conveys the booklet to the trimming section different from each other.

(2). A post-processing apparatus for processing image-recorded sheets, including: a transporting unit for transporting a booklet comprising a plurality of image-recorded sheets, the booklet having been conducted a processing; and an oscillating mechanism for oscillating the transporting unit to change a transporting plane angle of the transporting unit; wherein, the oscillating mechanism oscillates the transporting unit to vary the transporting plane angle at the time when the booklet is carried out from the transporting unit according to the booklet.

(3). A post-processing apparatus for processing an image-recorded sheet, including: a transporting unit for transporting the image-recorded sheet; and an oscillating mechanism for-oscillating the transporting unit to change a transporting plane angle of the transporting unit; wherein, the oscillating mechanism oscillates the transporting unit within a time period when the image-recorded sheet exists on the transporting unit.

(19). A post-processing apparatus for processing an image-recorded sheet, including: a plurality of post-processing sections arranged at vertically different positions with each other; a transporting unit adjustable of the transporting plane angle so that the image-recorded sheet is possible to be delivered and received between the plurality of post-processing positions; an oscillating mechanism for oscillating the transporting unit to change a transporting plane angle of the transporting unit; wherein, the oscillating mechanism oscillates the transporting unit to arrange different from each other, a first transporting plane angle at the time when the transporting unit receives the booklet from a first post-processing section provided at a higher position, a second transporting plane angle at the time when the transporting unit conveys the image-recorded sheet to a second post-processing section positioned at a lower position, and a third transporting plane angle at the time when the transporting unit carries out the image-recorded sheet processed by the second post-processing section.

(20). An image forming system provided with a post-processing section for conducting a post-processing of a sheet, the image forming system including: an image forming section for forming an image on the sheet; a transporting unit for transporting the sheet; and an oscillating mechanism for oscillating the transporting unit to change a transporting plane angle of the transporting unit; wherein, the oscillating mechanism oscillates the transporting unit within a time period when the sheet exists on the transporting unit.

BRIEF DESCRIPTION OF THE DRAWING

FIG. 12 shows a front view and a side cross-sectional view of a trimming apparatus.

FIG. 25 shows a cross-sectional view showing the state in which the discharge belt is stored in the post-processing apparatus, and a cross-sectional view showing the state in which the discharge belt is pulled out in the direction of the front side of the post-processing apparatus.

DETAILED DESCRIPTION OF THE PREFERRED EMBODIMENT

Figure 1:
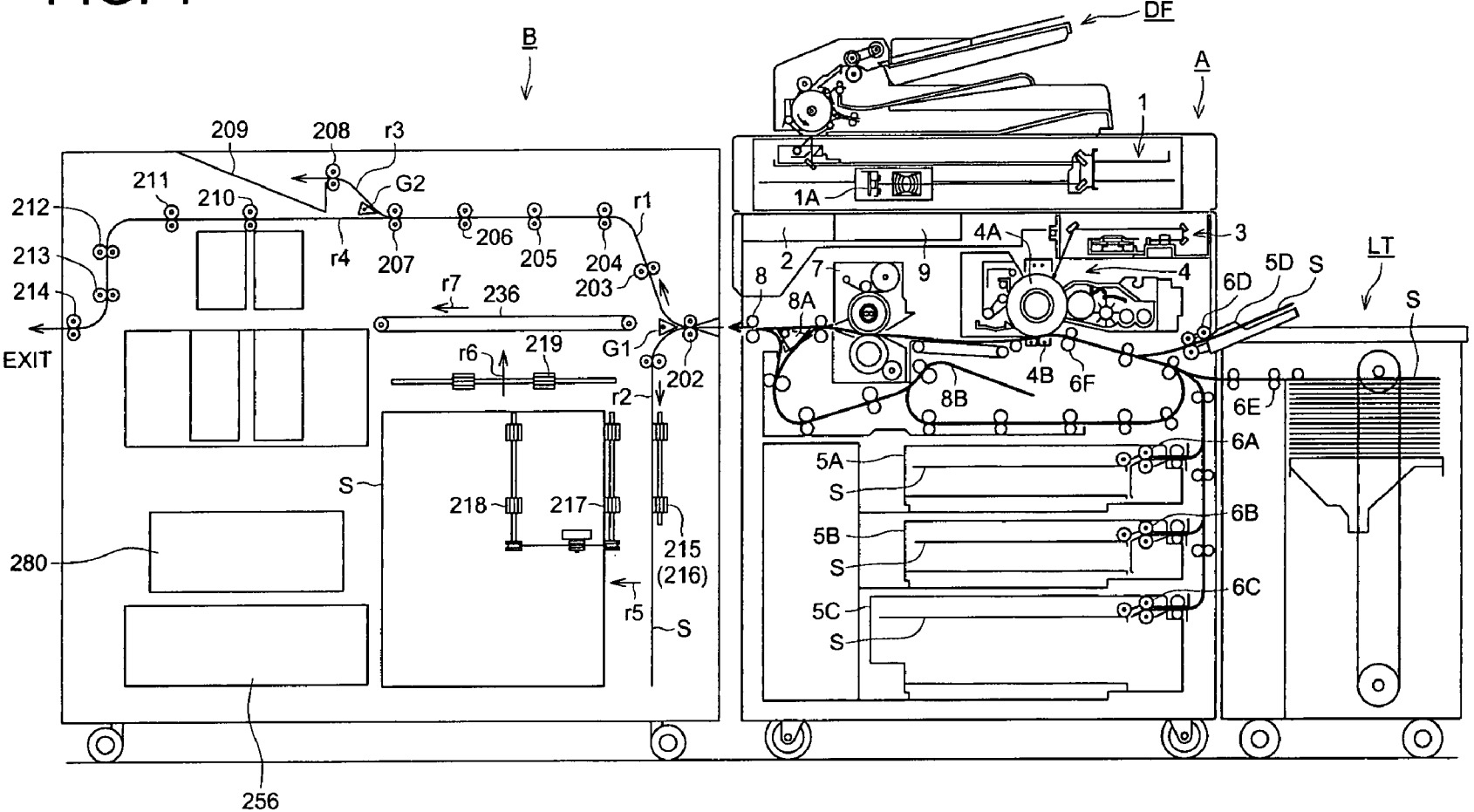
FIG. 1 is a schematic diagram of an image-forming system consisting of an image-forming apparatus, automatic document feeder, post-processing apparatus, and a large-capacity paper feeder.

The above objectives can be further achieved by the following configurations:

(4). The post-processing apparatus described in the aforementioned configuration (3), wherein the oscillating mechanism oscillates the transporting unit to arrange a first transporting plane angle at the time when the transporting unit receives the image-recorded sheet and a second transporting plane angle at the time when the transporting unit conveys the image-recorded sheet received to a position for a next processing different from each other.

(5). The post-processing apparatus of the configuration (3), further having a skew correcting unit on the transporting unit for correcting a skew of the image-recorded sheet, wherein, the skew correcting unit corrects the skew of the image-recorded sheet in a condition that the transporting plane of the transporting unit is inclined by the oscillating mechanism.

(6). The post-processing apparatus of the configuration (3), further having a plurality of post-processing sections arranged at vertically different positions with each other, wherein the transporting unit is provided to be adjustable of the transporting plane angle so that the image-recorded sheet is possible to be delivered and received between positions of the plural post-processing sections.

(7). The post-processing apparatus of the configuration (6), wherein the oscillating mechanism raises an image-recorded sheet receiving side of the transporting unit when the transporting unit receives the image recorded sheet from a post processing section arranged at a higher position, and lowers the image-recorded sheet receiving side of the transporting unit when the transporting unit delivers the image recorded sheet to a post processing section arranged at a lower position.

(8). The post-processing apparatus of the configuration (6), wherein among the plurality of post-processing sections, the post-processing section arranged at the higher position is a stitching section for stitching a plurality of image-recorded sheets, and the post-processing section arranged at the lower position is a trimming section for trimming an edge of a booklet comprising a plurality of stitched plural image recorded sheets.

(9). The post-processing apparatus of the configuration (8), further having a skew correcting unit on the transporting unit for correcting a skew of the image-recorded sheet, wherein the image-recorded sheet transported by the transporting unit is formed to be the booklet stitched by the stitching section, and wherein the booklet is delivered to the trimming section after the skew of the booklet is corrected by the skew correcting unit in a condition that the transporting plane of the transporting unit is inclined by the oscillating mechanism.

(10). The post-processing apparatus of the configuration (9), further having: a folding section for folding the image-recorded sheet; and a contact-pressing member for pressing the booklet at a vicinity of a folding line; wherein, after the folding section has conducted a center-folding processing and the stitching section has conducted a saddle-stitching processing to form the booklet, and after the skew correcting section has corrected a skew of the booklet, the contact-pressing member presses the booklet at the vicinity of a folding line, and an edge portion of the booklet is transported to the trimming section while the contact-pressing member keeps pressing the booklet.

(11). The post-processing apparatus of the configuration (10), further having a driving unit for moving the contact-pressing member to the trimming section while the contact-pressing member keeps pressing the booklet at the vicinity of a folding line.

(12). The post-processing apparatus of the configuration (3), wherein the oscillating mechanism oscillates the transporting unit to vary the transporting plane angle at the time when the image-recorded sheet is carried out from the transporting unit according to the image-recorded sheet.

(13). The post-processing apparatus of the configuration (12), wherein the oscillating mechanism oscillates the transporting unit to vary the transporting plane angle according to at least one of a kind, a number and a size of the image-recorded sheet.

(14). The post-processing apparatus of the configuration (12), wherein the oscillating mechanism oscillates the transporting unit to vary the transporting plane angle according to progress in number of the image-recorded sheet, which is continuously carried out from the transporting unit.

(15). The post-processing apparatus of the configuration (12), further having a folding section for folding the image-recorded sheet at upstream of the transporting unit in a transporting direction of the image-recorded sheet.

(16). The post-processing apparatus of the configuration (12), further having a stitching section for stitching a plurality of image-recorded sheets at upstream of the transporting unit in a transporting direction of the image-recorded sheet.

(17). The post-processing apparatus of the configuration (12), further having a discharging unit capable of stacking the image-recorded sheet carried out from the transporting unit and capable of moving to shift a stacking position of the image-recorded sheet.

(18). The post-processing apparatus of the configuration (12), further having: a folding section for folding the image-recorded sheet; a stitching section for stitching a plurality of image-recorded sheets; and a discharging unit capable of stacking a booklet comprising the plurality of image-recorded sheets having been folded, stitched, and carried out from the transporting unit, and capable of moving to shift a stacking position of the booklet; wherein the oscillating mechanism oscillates the transporting unit to vary the transporting plane angle according to at least one of a kind, a number and a size of the image-recorded sheet forming the booklet, or according to progress in number of the booklet, which is continuously carried out from the transporting unit.

PREFERRED EMBODIMENT OF THE INVENTION

Hereafter, a post-processing apparatus according to the present invention and an image-forming apparatus incorporating the post-processing apparatus will be described in detail with reference to the drawings. However, a post-processing apparatus according to the present invention and an image-forming apparatus incorporating the post-processing apparatus are not limited to the embodiment described below.

[Image-Forming Apparatus]

FIG. 1 is a schematic diagram of an image-forming system consisting of an image-forming apparatus A, automatic document feeder DF, post-processing apparatus B, and a large-capacity paper feeder LT.

As shown in the drawing, the image-forming apparatus A comprises an image-reading portion 1, image-processing portion 2, image-writing portion 3, image-forming portion 4, paper feed cassettes 5A, 5B and 5C, manual paper-feed tray 5D, 1st paper feeders 6A, 6B, 6C and 6D, 2nd paper feeder 6F, fixation apparatus 7, paper discharge portion 8, and an automatic both-side copy paper feeder (ADU) 8B.

An automatic document feeder DF is located at the upper part of the image-forming apparatus A. A post-processing apparatus B is connected to the paper discharge portion 8 which is located on the left side of the image-forming apparatus A as shown in the drawing.

The optical system of the image-reading portion 1 scans an image created on one side or images created on both sides of a document placed on the document placement board of the automatic document feeder DF, and then a CCD image sensor 1A reads the image or images.

Analog signals which have been photoelectrically transduced by the CCD image sensor 1A are analog-processed, A/D converted, processed with shading correction and image compression in the image-processing portion 2 and then sent to the image-writing portion 3.

In the image-writing portion 3, a semiconductor laser irradiates a ray of light onto a photoreceptor drum 4A in the image-forming portion 4 thereby creating a latent image. Processing, such as electrification, exposure, development, transfer, separation, and cleaning, is conducted in the image-forming portion 4. On a sheet S which has been fed from a paper feed cassette 5A through 5C, manual paper feed tray 5D, or a large-capacity paper feeder LT via a 1st paper feeder 6A through 6E, an image is transferred by a transfer means 4B. The sheet S which carries the image is fixed by a fixation apparatus 7 and sent from the paper discharge portion 8 to the post-processing apparatus B. Or, a sheet S one side of which has had an image processed is sent to the automatic both-side copy paper feeder 8B by means of the transporting passage switching board 8A, and then another image is processed on the other side of the sheet in the image-forming portion 4 and the sheet is then discharged from the paper discharge portion 8.

The operating portion 9 selects a processing function of the image-forming system consisting of an image-forming apparatus A and a post-processing apparatus B.

[Post-Processing Apparatus]

Figure 2:
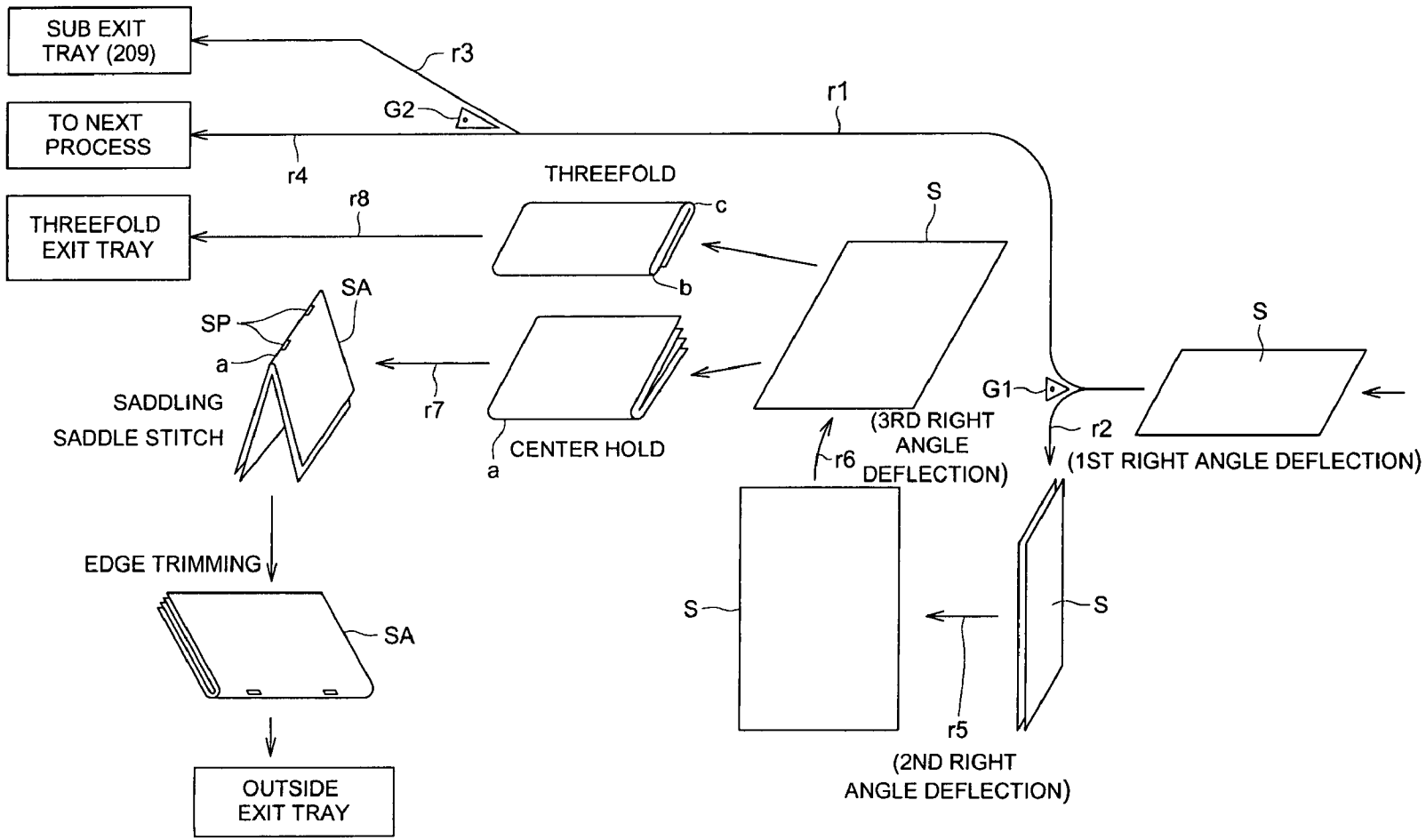
FIG. 2 is a frame format of the sheet transporting process in a post-processing apparatus.
Figure 3:
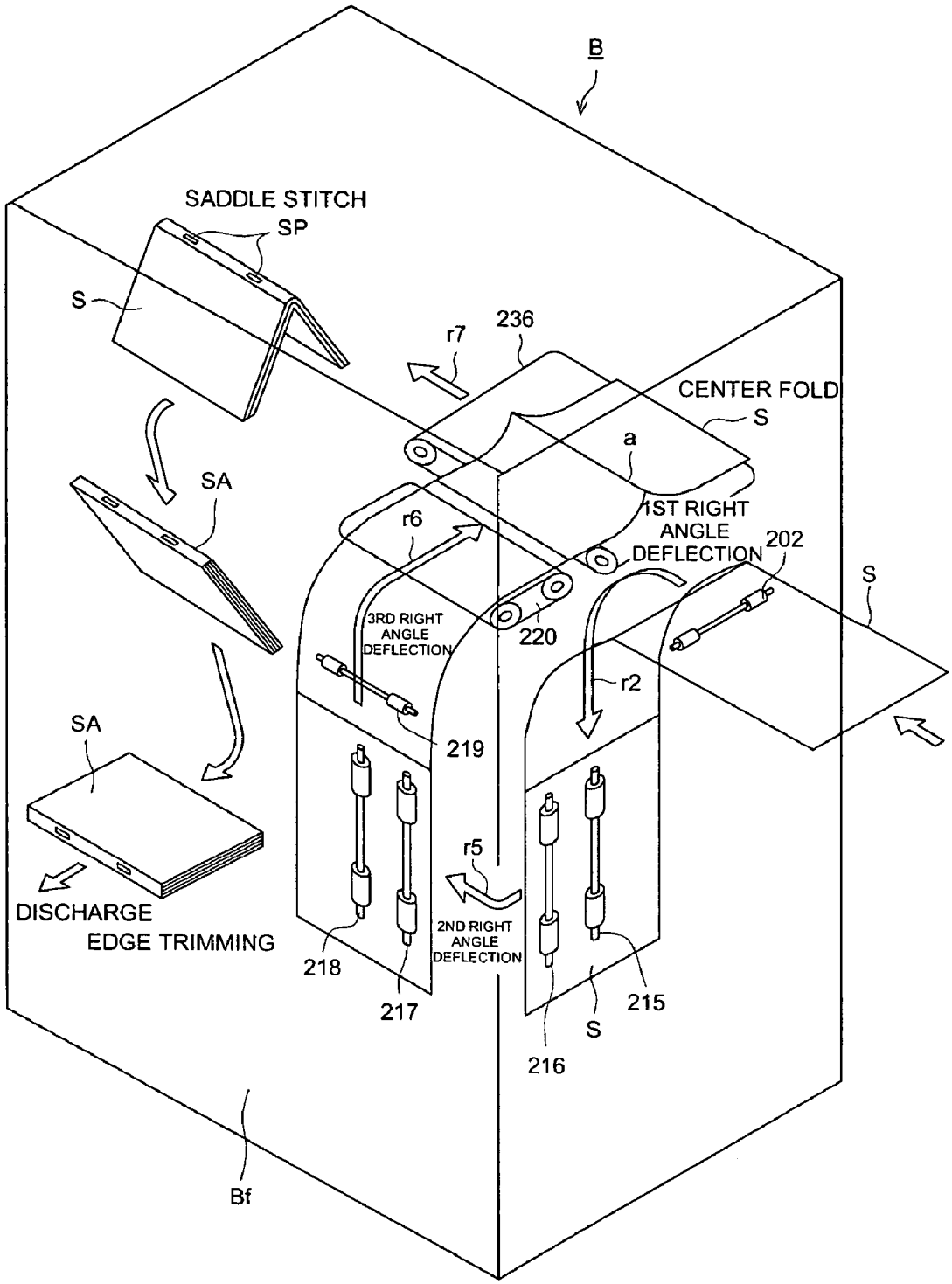
FIG. 3 is a frame format showing how sheets are transported during the center-folding and saddle-stitching processes in a post-processing apparatus.
Figure 4:
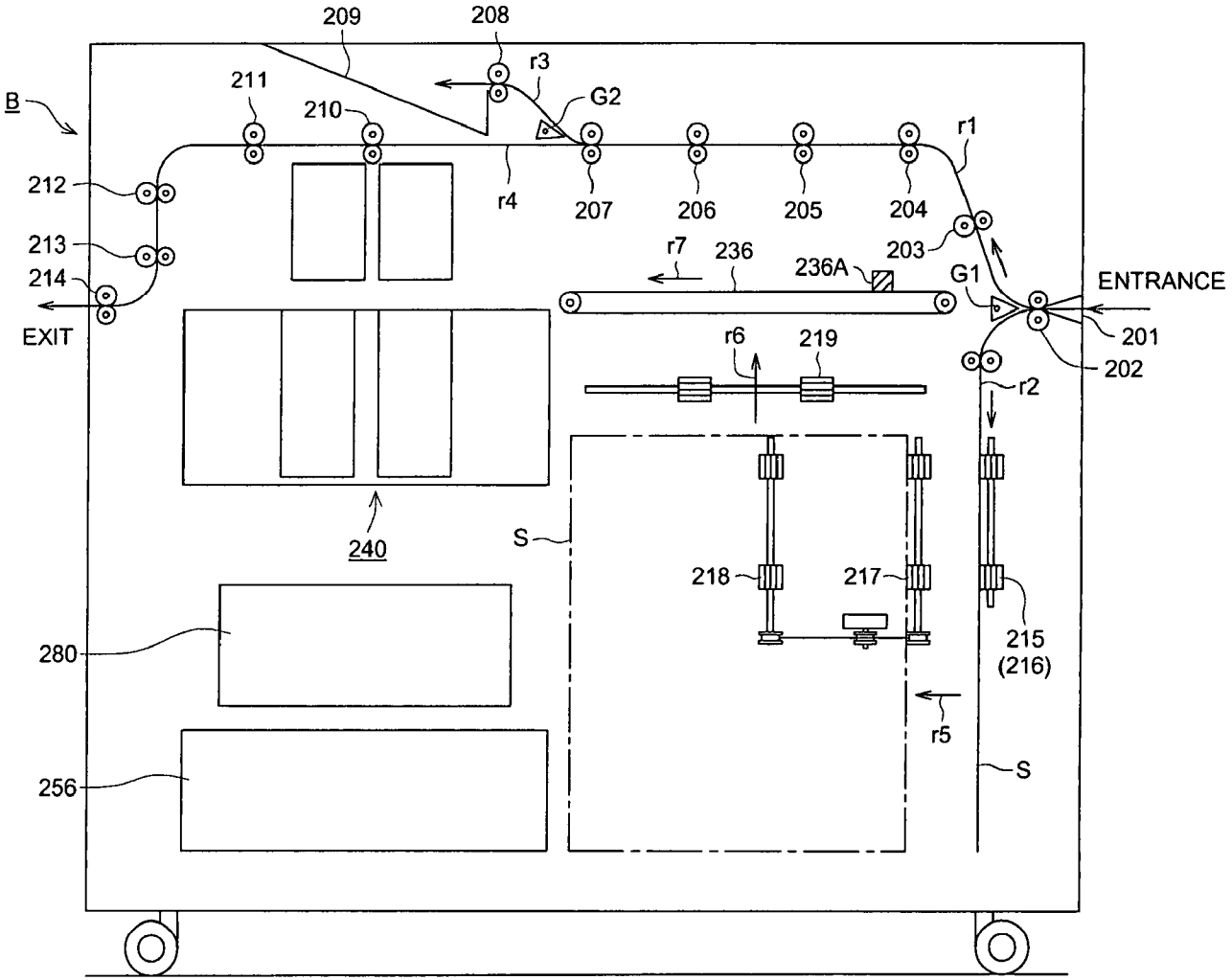
FIG. 4 is a front view of a post-processing apparatus.
Figure 5:
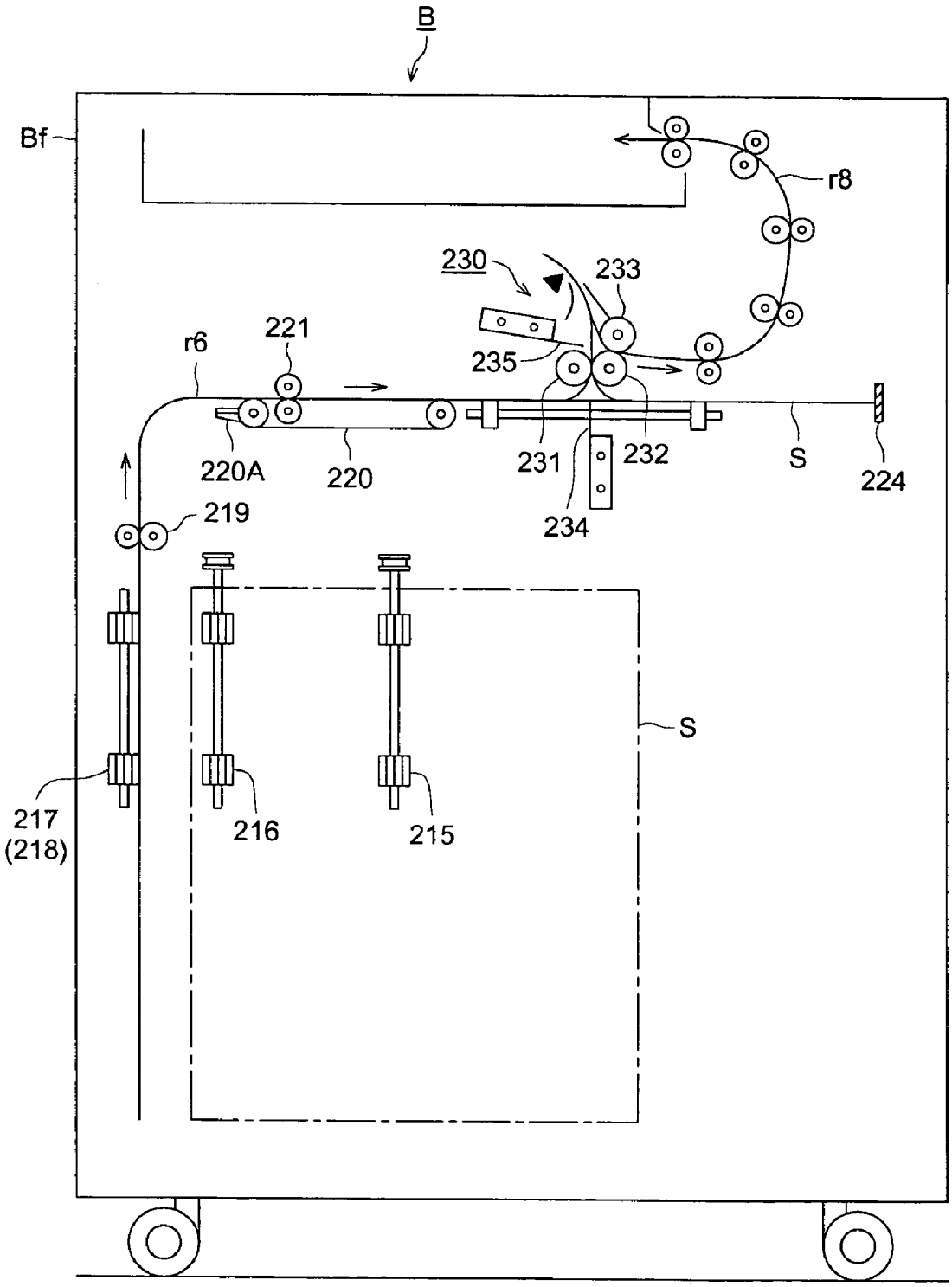
FIG. 5 is a right side view of a post-processing apparatus.
Figure 6:
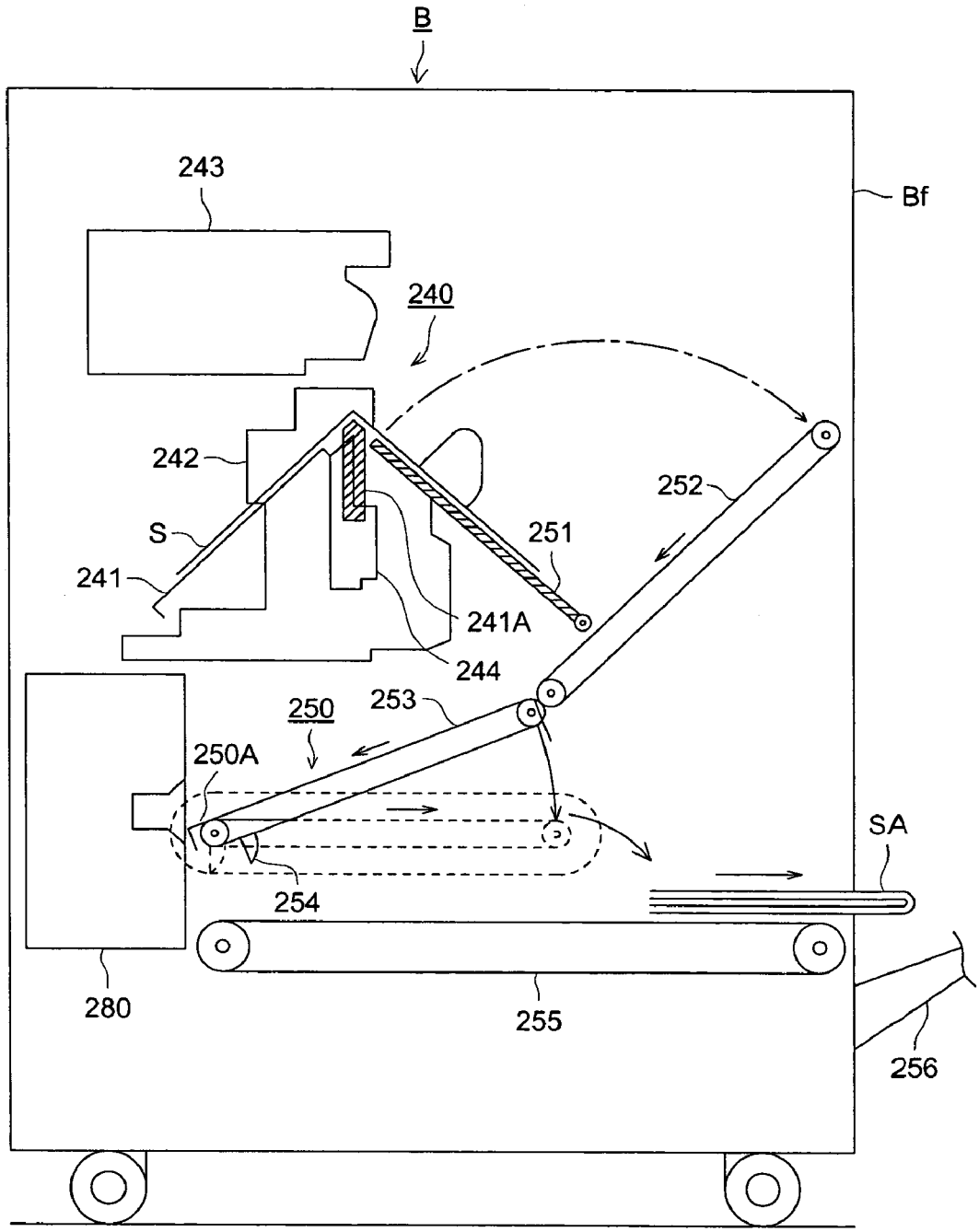
FIG. 6 is a left side view of a post-processing apparatus.

FIG. 2 is a frame format of the sheet transporting process in a post-processing apparatus. FIG. 3 is a frame format showing how sheets are transported during the center-folding and saddle-stitching processes in a post-processing apparatus. FIG. 4 is a front view, FIG. 5 is a right side view and FIG. 6 is a left side view of a post-processing apparatus.

First, the sheet transporting process, starting from a sheet being fed and up to the folding process, will be described.

As shown in FIGS. 1 and 4, a sheet S discharged from the image-forming apparatus A is loaded into an entrance (loading portion) 201 of the post-processing apparatus B, supported by an entrance roller 202, and then transported to either a transporting passage r1 above the transporting passage switching means G1 or transporting passage r2 below the transporting passage switching means G1.

<Straight Paper Discharge>

A sheet S transported to the transporting passage r1 is supported by transporting rollers 203 through 207, and then transported to either a transporting passage r3 above the transporting passage switching means G2 or transporting passage r4 below the transporting passage switching means G2.

The sheet S transported to the upper transporting passage r3 is discharged by a paper discharge roller 208 and then stacked on the sub exit tray (top tray) 209 located at the upper part of the post-processing apparatus B.

The sheet S transported to the lower transporting passage r4 is supported by transporting rollers 210 through 213 and then discharged by a paper discharge roller 214.

<1st Right Angle Deflection Transporting>

A sheet S transported to the transporting passage r2 below the transporting passage switching means G1 is lowered vertically, stops temporarily at a prescribed position and then stored. At the stop position, a plurality of sheets S discharged successively thereafter are stacked and stored.

<2nd Right Angle Deflection Transporting>

The stored sheet S is deflected in a direction perpendicular to its surface as shown in FIG. 2 by the transporting rollers 215 through 218 and a guide plate, not shown, passes through the transporting passage r5 which detours the sheet to the front side Bf in the post-processing apparatus B while the sheet surface stands upright, and temporarily stops at a prescribed position.

<3rd Right Angle Deflection Transporting>

Next, the sheet S is transported vertically in an upward direction by a transporting roller 219, deflected to a horizontal position, and then transported to an alignment means by the transporting alignment belt 220 and the transporting roller 221 (transporting passage r6).

<Alignment Prior to the Folding Process>

An alignment means consists of an alignment member 224, which is located downstream of the transporting passage r6 in the direction of transporting sheets and abuts the leading edge of the sheets to align the sheets, and a movable alignment block (alignment claw) 220A which contact-presses the trailing edge of the sheets S and transports them. The alignment block 220A contact-presses the trailing edge of the sheets S transported by a transporting roller 221 located upstream of the transporting passage r6 in the direction of transporting the sheets and transports the sheets to the alignment member 224, and then abuts the leading edge of the sheets against the alignment member 224 thereby aligning the sheets.

The following is a detailed explanation of the edge trimming process of the center-folded and saddle-stitched booklet made of sheets S in the post-processing apparatus B.

<Center-Folding Function>

A folding portion 230 is located downstream of the transporting alignment belt 220 in the direction of transporting sheets. The folding portion 230 consists of a 1st folding roller 231, 2nd folding roller 232, 3rd folding roller 233, 1st folding plate member 234, and a 2nd folding plate member 235.

One or more sheets S which have been carried to the folding portion 230 are supported by the 1st folding roller 231 and the 2nd folding roller 232 which rotate in the opposite directions to one another and the 1st folding plate member 234 which moves straight, and a fold "a" is created in the same direction as the width of the sheets in the middle of the sheet transporting direction (see FIG. 5).

After that, both the 1st folding roller 231 and the 2nd folding roller 232 are rotated in the reverse directions. The sheet S on which a fold "a" has been created is removed from the position at which it was nipped by the 1st folding roller 231 and the 2nd folding roller 232 and returned to the original horizontal transporting passage. The sheet S is then transported by a transporting claw 236A (see FIG. 4) mounted to the rotating transporting belt 236 to the transporting passage r7 located in the direction of the extension line of the fold "a" (see FIGS. 2 and 3), and then sent to the saddle-stitching portion 240.

Thus, the folding portion 230 center-folds one to three sheets S to precisely create a fold "a", and one by one sends the sheets to the saddle-stitching portion 240. As a result, it is possible to make a high-quality booklet (book-bound item) SA which has minimum swollen along the fold "a".

<Saddle-Stitching Function>

The sheet S center-folded in the folding portion 230 is transported to the transporting passage r7 by the transporting belt 236 and a guide means, not shown, and is placed on the saddling integration member 241 located in the saddle-stitching portion 240. The subsequent center-folded sheet S is then also transported via the transporting passage r7 and placed on the saddling integration member 241 (see FIG. 6).

The saddling integration member 241 consists of two guide plates which are almost perpendicular to one another, and is mounted to the main body of the apparatus. In the vicinity of the top of the saddling integration member 241, a contact-pressing member 241A which can be lifted by means of the spring force is placed into position and supported by a staple receiving mechanism 244.

The top of the contact-pressing member 241A is convex which is almost perpendicular in an upward direction and the fold "a" (see FIG. 2) of the center-folded sheet S is placed on the top ridgeline.

A plurality of sheets S placed on the saddling integration member 241 and the contact-pressing member 241A are aligned by a width alignment means 242.

A stapling mechanism 243 is firmly installed above the contact-pressing member 241A. Inside the saddling integration member 241, the contact-pressing member 241A and the staple receiving mechanism 244 are supported in such a way that allows them to move vertically.

Two sets of block-structured binding means which consists of a stapling mechanism 243 and a staple receiving mechanism 244 are disposed in the same direction as that of the sheets' fold. When the saddle-stitching is selected by the operating portion, the staple receiving mechanism 244 lifts and conducts the saddle-stitching process. That is, two sets of binding means staple the booklet SA placed on the contact-pressing member 241A by using staples SP at two center distribution locations along the fold "a". The center-folded and saddle-stitched booklet SA is shown in a perspective view in FIG. 3.

<Booklet Trimming Function>

The booklet SA which has been saddle-stitched in the saddle-stitching portion 240 is supported by a guide member 251 that can oscillate and is oscillated in the direction, indicated by the dot-dash line, and is placed on the transporting belt 252. The booklet SA is transported obliquely downward by the circular movement of the transporting belt 252, held at an angle, transferred by the rotating transporting belt 253 and then stops at a prescribed position.

After that, the transporting belt 253 oscillates to become horizontal. The edge (free end on the opposite side of the fold) of the booklet SA which is placed on the horizontally located transporting belt 253 is uneven because multiple sheets of the booklet SA have been bound, and therefore, the edge is trimmed by the trimming apparatus (trimmer) 280 to neatly align the edge.

The trimmed booklet SA is loaded on the reverse-rotating transporting belt 253 and is transported while the trailing edge of the booklet SA is being contact-pressed by a contact member (movable alignment member) 254 mounted to the transporting belt 253, and then the booklet is discharged from the leading edge of the transporting belt 253 in the direction indicated by the arrow. The ejected booklet SA is discharged by the rotating discharge belt 255 in the exit tray 256 located outside the front side Bf of the post-processing apparatus B.

[Edge Trimming]

Next, the mechanism of the trimming apparatus 280 and the drive means for transporting booklets will be described in detail.

<Drive Means for Transporting Booklets>

Figure 7:
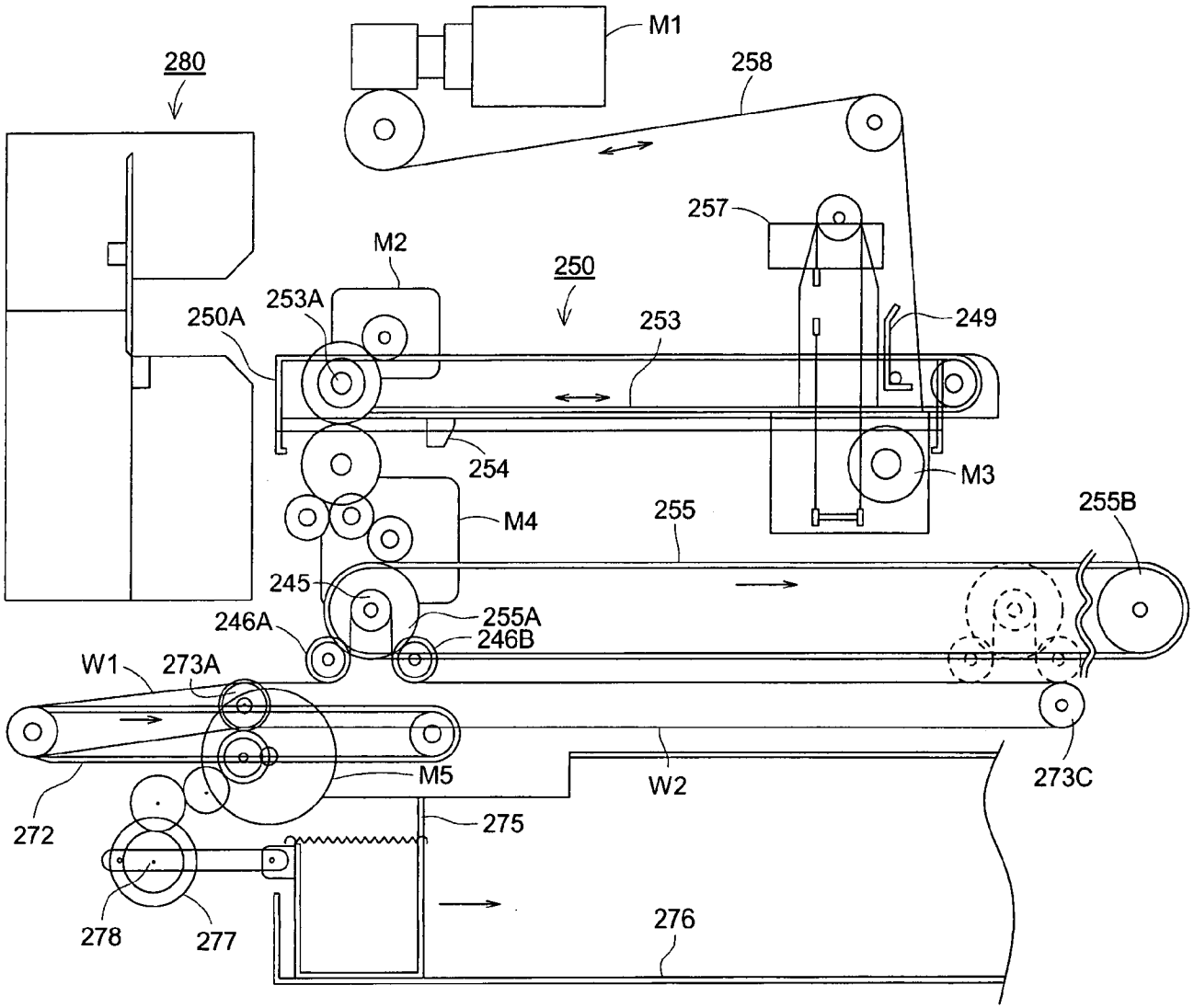
FIG. 7 is a schematic diagram of a drive mechanism for transporting booklets.

FIG. 7 is a schematic diagram of a drive mechanism for transporting booklets.

The motor M1 oscillates the transporting belt 253 around the drive roller rotating shaft 253A and lifts the belt. The motor M2 rotates in two directions, forward and reverse, the transporting belt 253 which incorporates the contact member 254. The motor M3 lifts the pressing plate 257 which contact-presses the vicinity of the fold of the booklet SA. The motor M4 moves a mobile body 261 straight in the direction of transporting the booklet. (This will be explained in detail in FIG. 9.) The motor M5 rotates the discharge belt 255 which winds around both the drive roller 255A and the driven roller 255B, rotates the trimmed-scrap transporting belt 272, and moves the transfer member 275 of the trimmed-scrap container 276.

Figure 8:
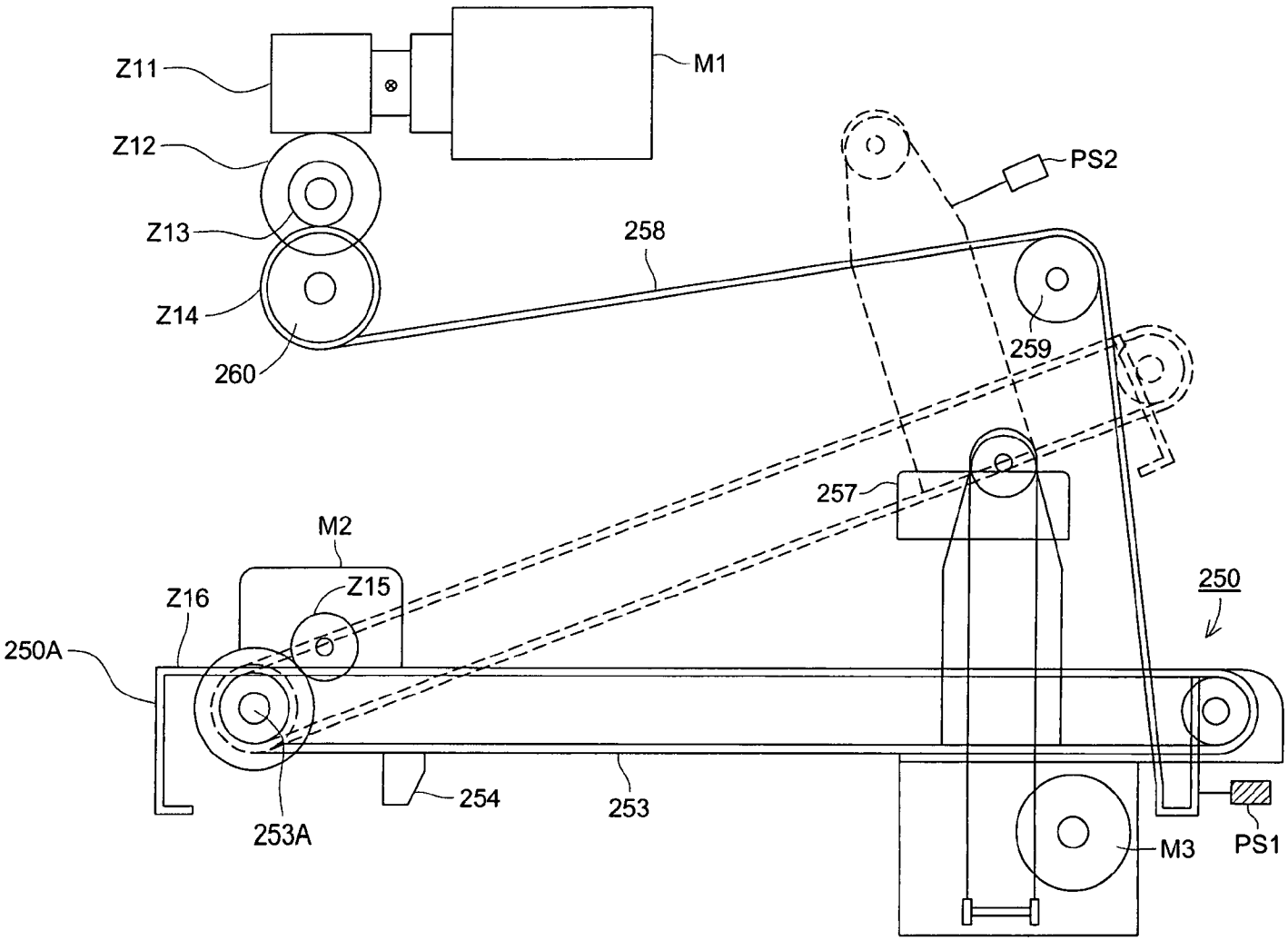
FIG. 8 is a cross-sectional view of an oscillating mechanism for oscillating a booklet transporting means and a transporting belt.

FIG. 8 is a cross-sectional view of an oscillating mechanism for oscillating a booklet transporting means and a transporting belt 250.

The transporting belt 253 of the booklet transporting means 250 is supported such that it can oscillates around the drive roller rotating shaft 253A. A wire 258 one end of which is latched to the end (the right side as shown in the drawing) of the booklet transporting means 250 is deflected along the outer circumferential surface of the intermediate roller 259 which is rotatably supported by the apparatus' main body, and winds around the outer circumferential surface of the pulley 260, and then the other end of the wire is mounted to the pulley 260 in the tensioned state.

A gear Z14 mounted to the rotating shaft of the pulley 260 is connected to the gear Z11 which is mounted to the motor M1's drive shaft via the intermediate gears Z13 and Z12.

The motor M1 rotates the pulley 260 to wind up the wire 258, lifts a booklet transporting means 250 consisting of a booklet placement board 250A and a transporting belt 253, and oscillates the booklet transporting means 250 upward around the drive roller rotating shaft 253A and lifts it. The lifting position of the booklet transporting means 250 is indicated in the broken line. PS1 denotes a sensor for detecting the lower-limit position of the booklet transporting means 250 and PS2 denotes a sensor for detecting the lower-limit position of the booklet transporting means 250.

To lower the booklet transporting means 250 to a horizontal position, the motor M1 drives in the reverse direction to change the rotation direction of the pulley 260, releases the tension force of the wire 258, and then the booklet transporting means 250 is allowed to be lowered by its own weight.

The motor M2 rotates the drive roller rotating shaft 253A via gears Z15 and Z16 to rotate the transporting belt 253 in the forward and reverse direction.

<Drive Means for Lifting the Pressing-Plate>

Figure 9:
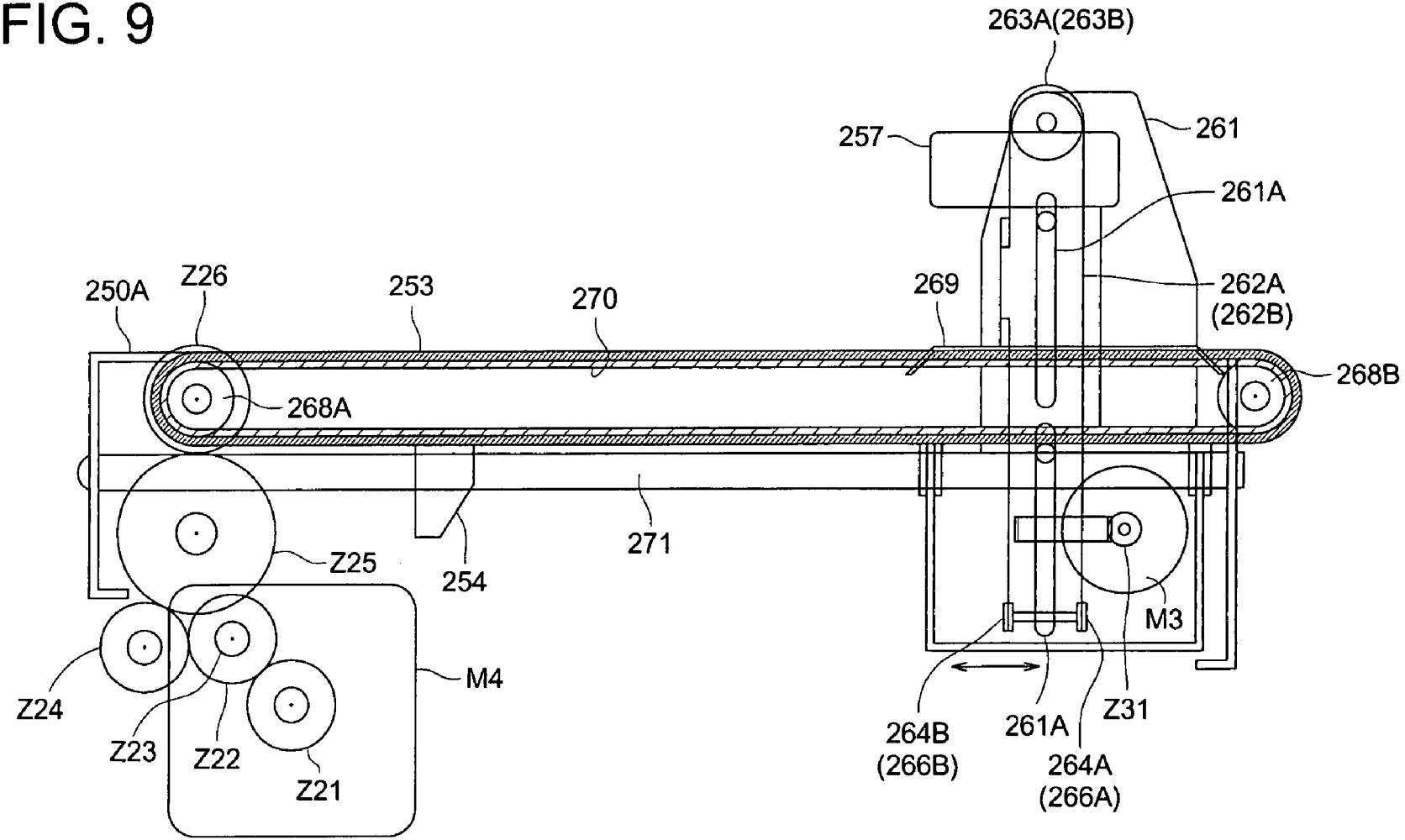
FIG. 9 is a cross-sectional view which shows a drive means for lifting a pressing plate and a transfer means for moving a mobile body that supports the pressing plate in the direction of transporting booklets.

FIG. 9 is a cross-sectional view which shows a drive means for lifting a pressing plate 257 and a transfer means for moving a mobile body 261 that supports the pressing plate 257 in the direction of transporting booklets.

The transfer means for moving a mobile body in the direction of transporting booklets comprises a booklet supporting plate 269 mounted to the mobile body 261, a pressing plate 257 which can be lifted, a mobile-body drive means, and a drive means for lifting a pressing plate.

The motor M3 lifts the pressing plate 257 which contact-presses the vicinity of the fold of the booklet SA. The pressing plate 257 is supported along the long groove 261A of the mobile body 261 such that it can be lifted.

Figure 10:
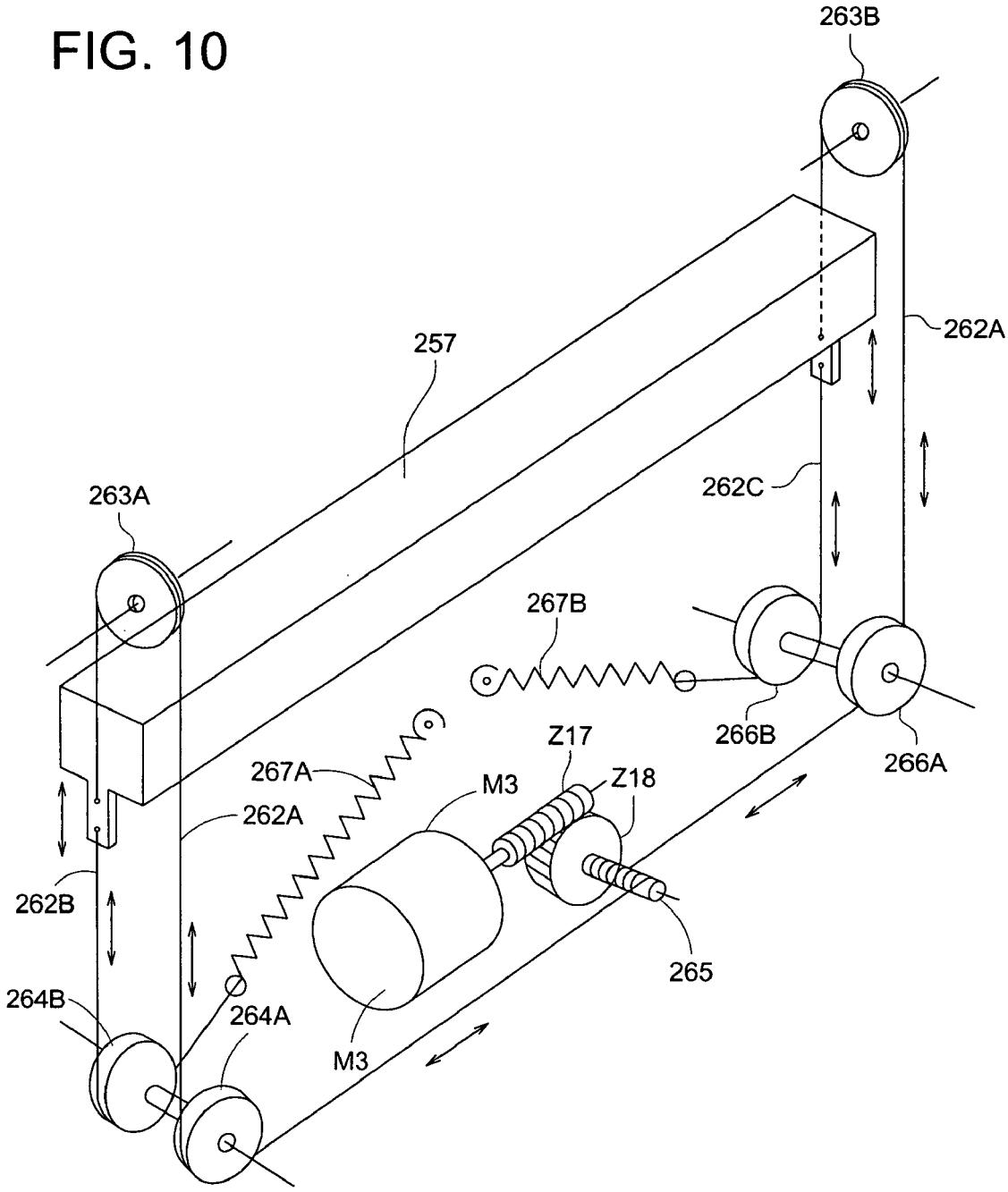
FIG. 10 is a perspective view of a drive means for lifting a pressing plate.

FIG. 10 is a perspective view of a drive means for lifting a pressing plate 257.

The 1st wire 262A one end of which is latched to the pressing plate 257 winds around the sheave 263A, winds around the pulley 264A, also winds around the outer circumferential surface of the pulley 265 a plurality of times, and then winds around the pulley 266A, winds around the sheave 263B, and then the other end of the wire 262A is mounted to the pressing plate 257 in the tensioned state.

The 2nd wire 262B one end of which is latched to the pressing plate 257 winds around the pulley 264B and then connected to one end of the spring 267A. The other end of the spring 267A is latched to the apparatus' main body.

The 3rd wire 262C one end of which is latched to the pressing plate 257 winds around the pulley 266B and then connected to one end of the spring 267B. The other end of the spring 267B is latched to the apparatus' main body.

The forward rotational drive of the motor M3 rotates the pulley 265 in the forward direction via gears Z17 and Z18, and the wire 262A is wound up and then the pressing plate 257 is elevated via the sheaves 263A and 263B.

The reverse rotational drive of the motor M3 reverses the rotation of the pulley 265, and the wire 262A changes the position in the reverse direction, making it possible to lower the pressing plate 257 via sheaves 263A and 263B. The wire 262B latched to the pressing plate 257 lowers the pressing plate 257 by means of the force of the spring 267A. Simultaneously, the wire 262C latched to the pressing plate 257 lowers the pressing plate 257 by means of the force of the spring 267B. As the pressing plate 257 lowers, the vicinity of the fold of the booklet SA loaded on the booklet placement board 250A is contact-pressed.

<Drive Means for Moving the Pressing Plate in the Direction of Transporting Booklets>

In FIG. 9, the motor M4 moves the pressing plate 257 straight in the direction of transporting booklets. The rotational drive of the motor M4 rotates a drive pulley 268A via gears Z21, Z22, Z23, Z24, Z25 and Z26. A mobile body 261 is latched to the belt 270 which winds around the drive pulley 268A and the driven pulley 268B. The mobile body 261 is supported by the guide bar 271 which is installed on the booklet placement board 250A in parallel with the direction of transporting booklets so that the mobile body 261 can slide. The rotational drive of the motor M4 rotates the belt 270 and moves the mobile body 261 back and forth along the guide bar 271.

<Driving the Reference Alignment Member>

Figure 11:
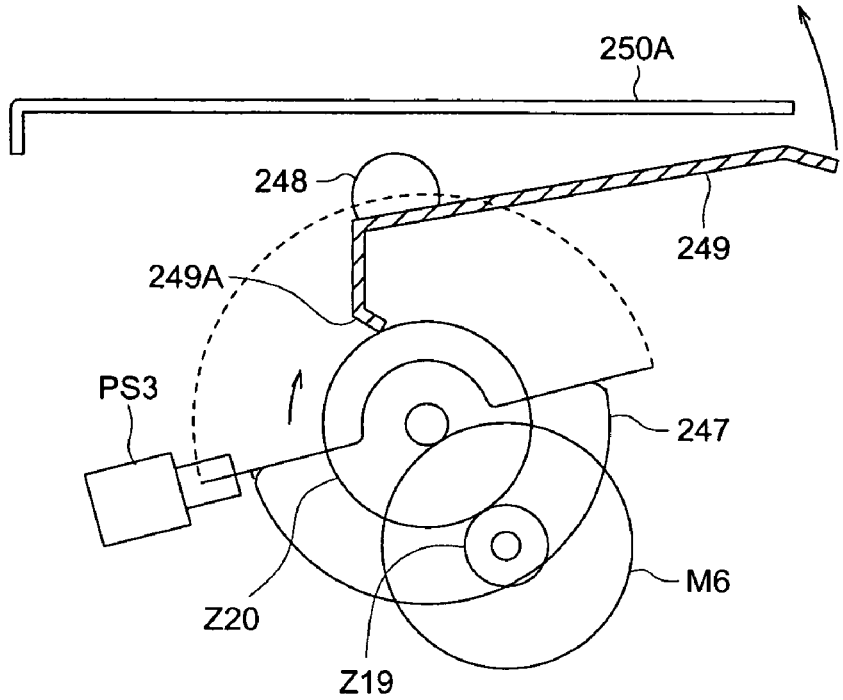
FIG. 11 shows cross-sectional views of a drive mechanism for a reference alignment member.
Figure 11:
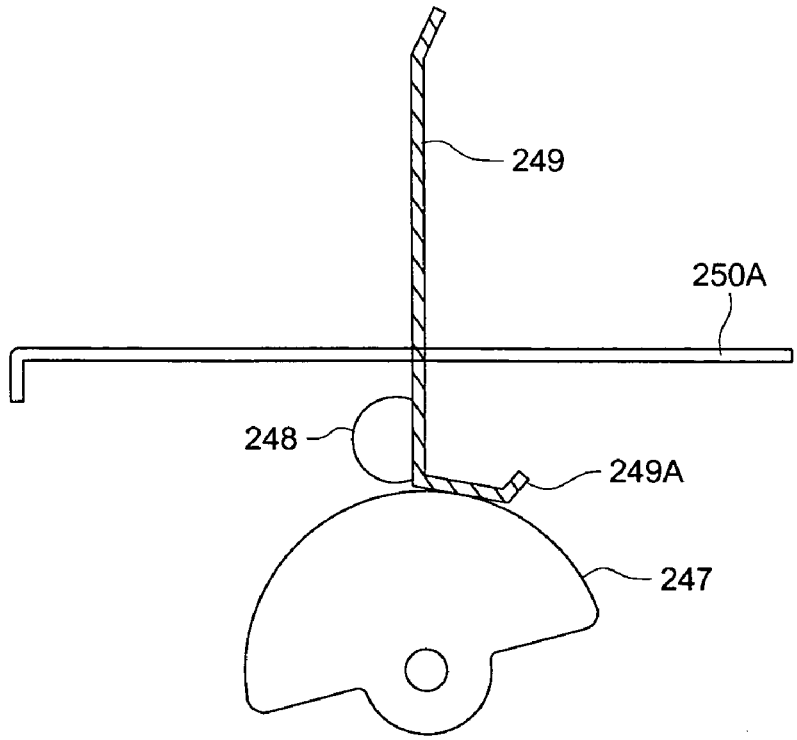

FIGS. 11(*a*) and (*b*) are cross-sectional views of a drive mechanism for a reference alignment member 249. FIG. 11(*a*) shows the reference alignment member 249 positioned below the booklet placement board 250A, and FIG. 11(*b*) shows the reference alignment member 249 in the upright position and protruding upwardly over the booklet placement board 250A.

The reference alignment member 249 is mounted to the oscillating shaft 248 installed on one end of the booklet placement board 250A so that the member can oscillate (see FIG. 7). In the initial state, the reference alignment member 249 stands by in such a way that it is positioned below the booklet placement board 250A (see FIG. 11(*a*)).

The motor M6 rotates a fan-shaped cam 247 via gears Z19 and Z20. The cam 247 rotates clockwise, as shown in the drawing, contact-presses the trailing edge 249A of the reference alignment member 249, oscillates the leading edge of the reference alignment member 249 around the oscillating shaft 248 in the direction indicated by the dot-dash line, as shown in the drawing, thereby making the reference alignment member 249 upright (see FIG. 11(*b*)). A sensor PS3 detects the initial position and the upright position of the reference alignment member 249.

<Trimming Apparatus>

FIG. 12(*a*) is a front view of the trimming apparatus 280, and FIG. 12(*b*) is a side cross-sectional view of the trimming apparatus 280.

The trimming apparatus 280 consists of a rotating upper blade 281 which simultaneously rotates and moves straight in the width direction perpendicular to the direction of transporting booklets, a fixed lower blade 282 mounted in the booklet's width direction, a drive means for simultaneously rotating and moving straight the rotating upper blade 281, and a booklet holding member 290 (see FIG. 13) which contact-presses the vicinity of the edge of the booklet SA.

The trimming apparatus 280 has a heavy weight and causes a large load at the time of trimming, therefore it is preferable that the trimming apparatus is arranged horizontally beneath the post-processing apparatus B. By arranging in such a way, cost increase due to a member for fixing the trimming apparatus 280 is suppressed, and steady good quality of trimming can be obtained.

The motor M7 rotates a ball screw 284 installed in the trimming apparatus' main body 286 via a timing belt 283, and moves straight the rotating upper blade's mobile body 285 on which a rotating upper blade 281 is installed. The rotating upper blade's mobile body 285 moves in a straight line between the initial position sensor (HP sensor) PS4 and a sensor PS5.

A rack gear Z31 is mounted to the trimming apparatus' main body 286 in parallel with the rotation center line of the ball screw 284. A pinion gear Z32 is located on the rotating upper blade's mobile body 285 in such a way that the gear can rotates, meshes with a rack gear Z31, and is then driven and rotates as the result of the movement of the rotating upper blade's mobile body 285. The rotation of the pinion gear Z32 rotates a gear Z27 mounted to the drive conveying shaft 287 which holds the pinion gear Z32, and rotates the rotating upper blade 281 via gears Z28, Z29 and Z30. Therefore, the motor M7 simultaneously rotates the rotating upper blade 281 and moves it in a straight line. The rotating upper blade 281 is pressed onto the fixed lower blade 282 by means of the force of the spring 282.

<Drive Means for Holding a Booklet>

Figure 13:
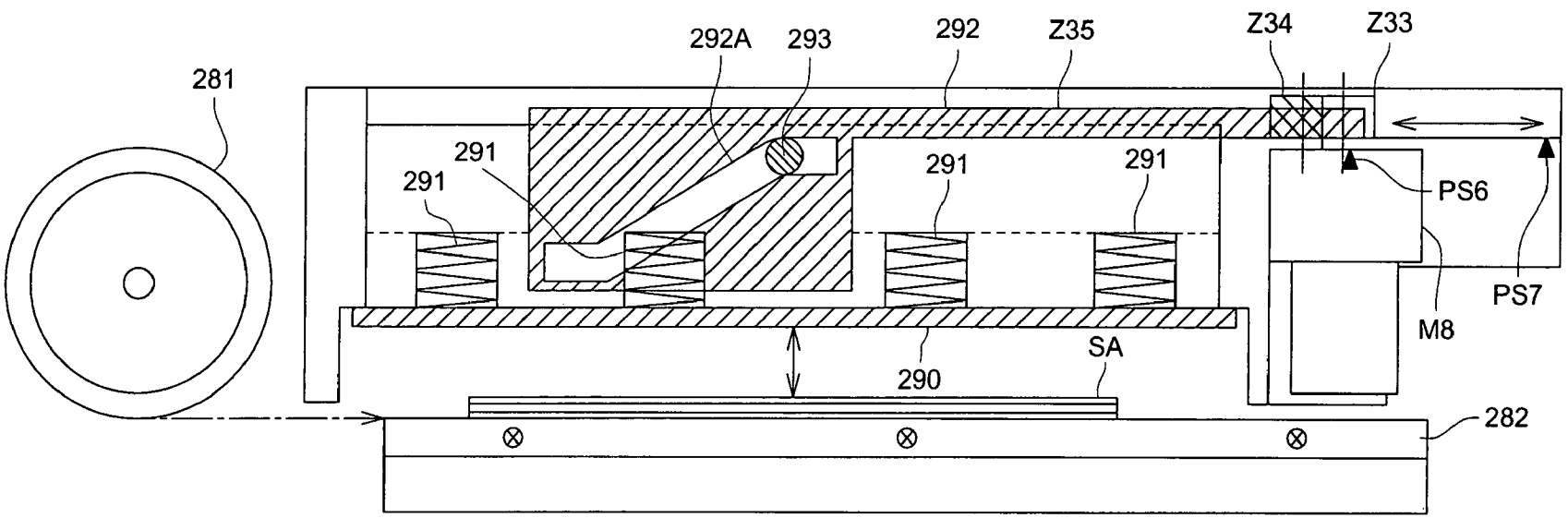
FIG. 13 is a cross-sectional view of a drive means for a booklet holding member.

FIG. 13 is a cross-sectional view of a drive means for a booklet holding member 290.

The booklet holding member 290 which contact-presses the vicinity of the edge of the booklet SA is vertically driven by a cam mechanism and contact-presses the booklet SA by means of a contact-pressing spring 291. Although the thickness of booklets SA differs, the difference is reduced by means of a plurality of contact-pressing springs 291.

The motor M8 rotates a pinion gear Z34 via a gear Z33, and then moves straight a transfer member 292 having a rack gear Z35 which meshes with the pinion gear Z34. A roller 293 installed in the booklet holding member 290 is movably engaged with a cam groove 292A located in the transfer member 292.

As the result of the straight movement of the transfer member 292, cam groove 292A presses down the roller 293, and then a transfer member 292 that clamps the roller 293 moves a prescribed distance and lowers to contact-press the booklet SA.

Lifting and transfer of the booklet holding member 290 is restricted by the vertical length of the cam groove 292A located in the transfer member 292. Therefore, it is possible to control lifting and transfer of the booklet holding member 290 by means of sensors PS6 and PS7 detecting the distance the transfer member 292 moves in a straight line.

<Drive Means for Discharging Trimmed Scraps>

Figure 14:
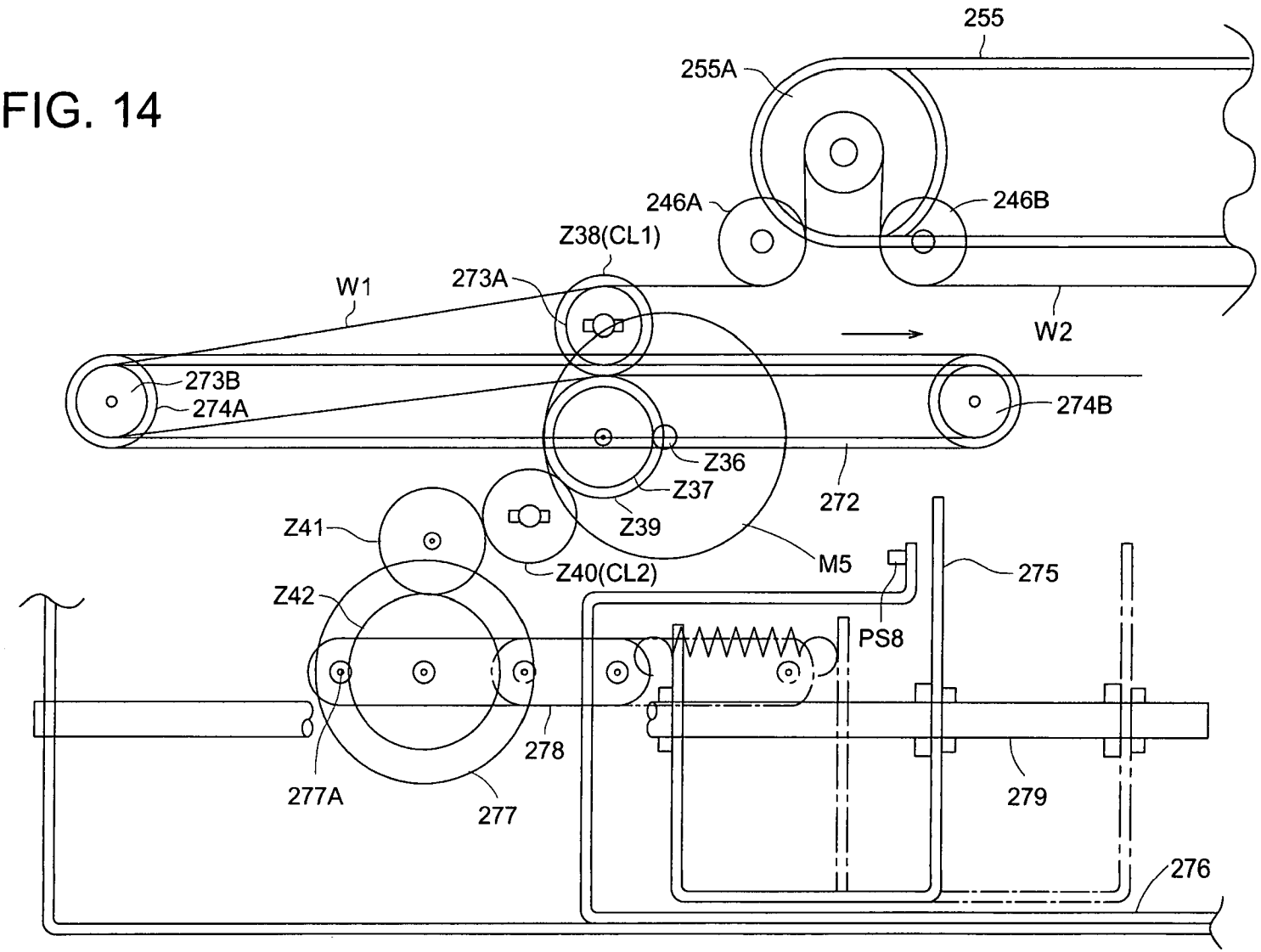
FIG. 14 is a cross-sectional view of a drive means for discharging trimmed scraps.

FIG. 14 is a cross-sectional view of a drive means for discharging trimmed scraps.

The motor M5 rotates a discharge belt 255, rotates a trimmed-scrap transporting belt 272, and moves a transfer member 275 located in the trimmed-scrap container 276.

The motor M5 meshes with a gear Z38 incorporating a one-way clutch via gears Z36 and Z37. A wire W1 winds around a pulley 273A located on the same shaft as the gear Z38 and a pulley 273B. The trimmed-scrap transporting belt 272 winds around the pulley 274A located on the same shaft as the pulley 273B and the other pulley 274B.

As the motor M5 rotates in the forward direction, the trimmed-scrap transporting belt 272 is rotated in the direction indicated by the arrow via gears Z36 through Z38 and the wire W1. After the edge of a booklet has been trimmed by a trimming apparatus 280, trimmed scraps fall. Scraps are guided by an eject guide plate, not shown, fall on the rotating trimmed-scrap transporting belt 272, are transported and stored in the trimmed-scrap container 276.

The motor M5 rotates a rotating disc 277 via gears Z36 and Z37, a gear Z40 incorporating a one-way clutch, and gears Z41 and Z42. One end of a clank 278 engages with a shaft 277A installed at an eccentric position of the rotating disc 277. The other end of the clank 278 is connected to a transfer member 275. The transfer member 275 comes in sliding contact with the guide bar 279 so that it can moves back and forth.

Trimmed scraps which have been transported by a trimmed-scrap transporting belt 272 and ejected into the entrance of the trimmed-scrap container 276 are transported to the inner part of the trimmed-scrap container 276 by the transfer member 275 which moves back and forth.

A one-way clutch CL1 is built in the gear Z38 which meshes with a gear Z39 driven by the motor M5, and another one-way clutch CL2 is built in the gear Z40 which meshes with the gear Z39.

The drive mechanisms for the discharge belt 255 which discharges trimmed booklets SA, trimmed-scrap transporting belt 272 and the transfer member 275 can be selectively controlled in such a way that the forward rotation of a single motor M5 drives the discharge belt 255, and the reverse rotation of the motor M5 drives the trimmed-scrap transporting belt 272 and the transfer member 275. As a consequence, it is possible to use the same drive source (motor M5) and selectively control the drive of the booklet SA discharge and the trimmed-scrap transportation.

<Discharge Belt Drive Means>

A wire W2 winds around a pulley 273A, which is rotated by the motor M5, at a location different from where a wire W1 is wound. The wire W2 winds around pulleys 273A and 273C, a pair of pulleys 246A and 246B, and a pulley 245 mounted to the rotating shaft of the drive roller 255A of the discharge belt 255.

As the motor M5 drives, the wire W2 rotates, and rotation of the drive roller 255A will rotate the discharge belt 255.

By electrically or manually pulling out the discharge belt 255 toward the front side Bf of the post-processing apparatus B, pulleys 245, 246A and 246B are also pulled out together with the drive roller 255A, and then moved to the location indicated by the broken line (see FIG. 7). Pulling out the discharge belt 255 will be explained in FIG. 25.

[Booklet Transporting Process]

Figure 20:
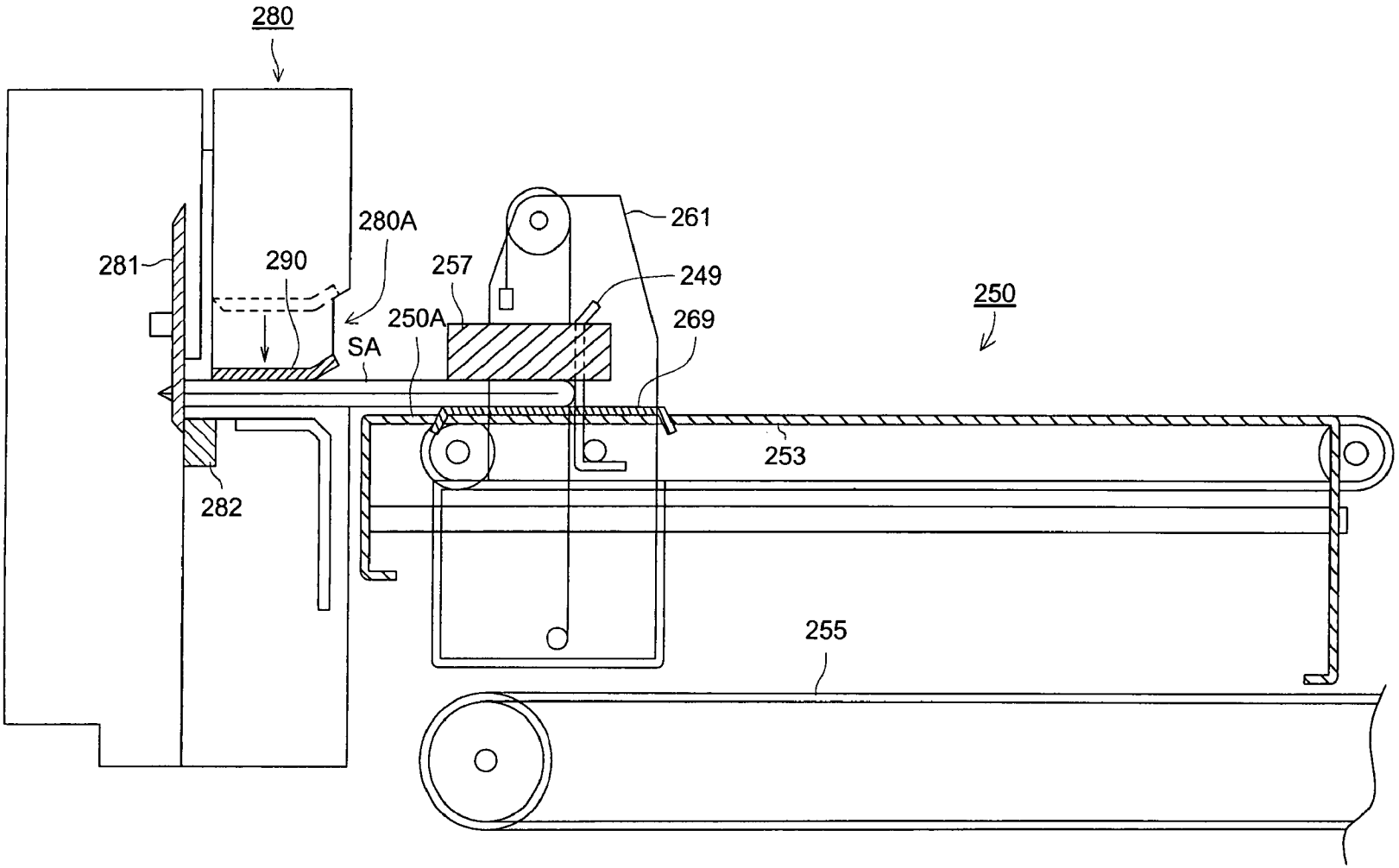
FIG. 20 is a cross-sectional view showing the process in which the edge of a booklet is trimmed by a trimming apparatus.
Figure 21:
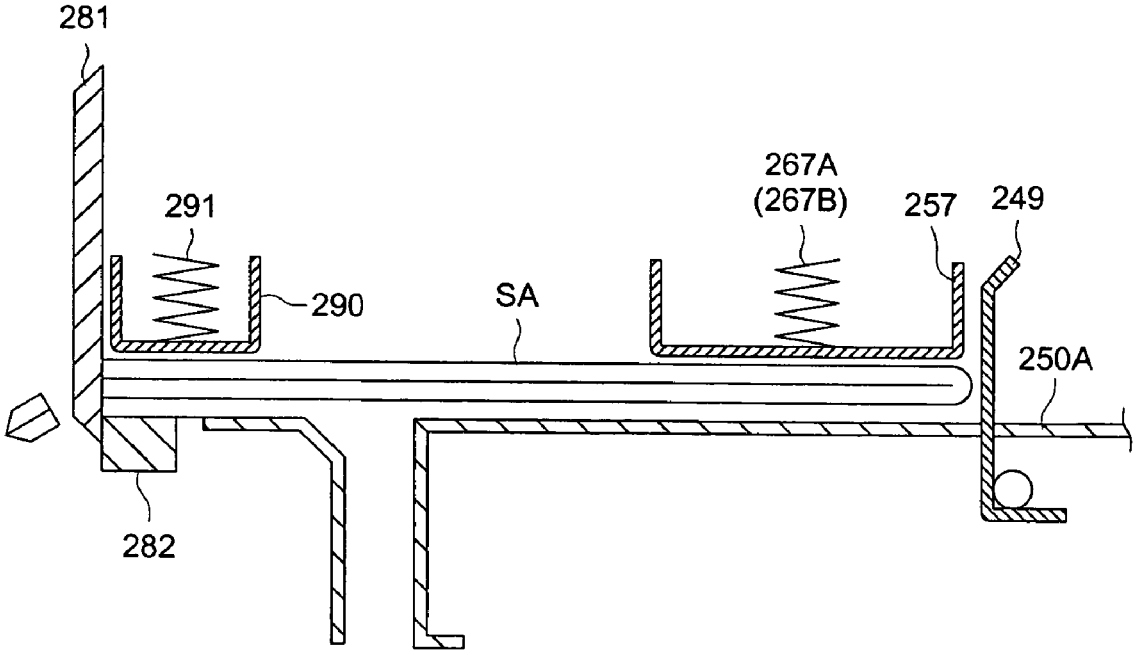
FIG. 21 is a cross-sectional view showing the process in which the edge of a booklet is trimmed by a trimming apparatus.
Figure 22:
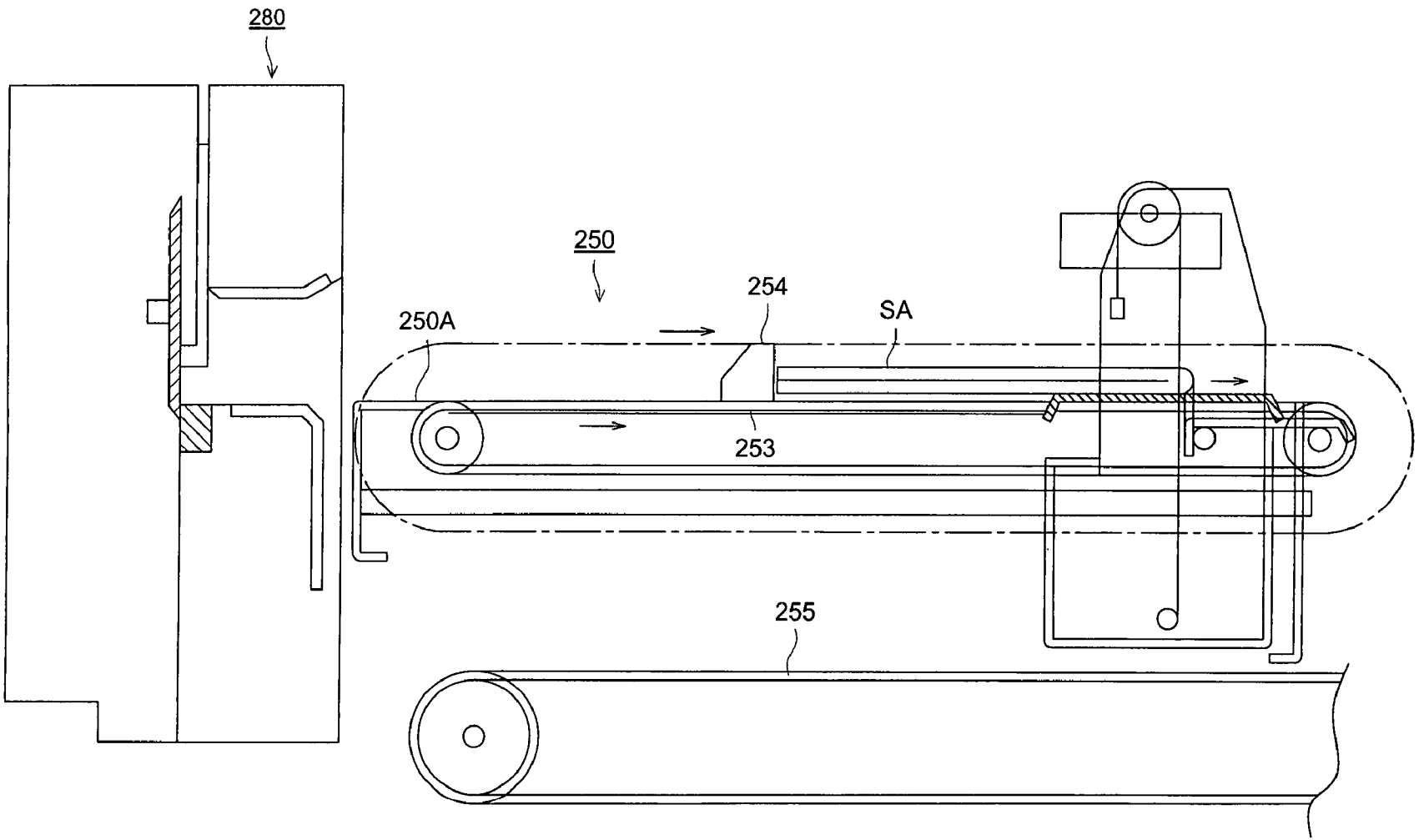
FIG. 22 is a cross-sectional view showing the process in which the trimmed booklet is discharged.
Figure 23:
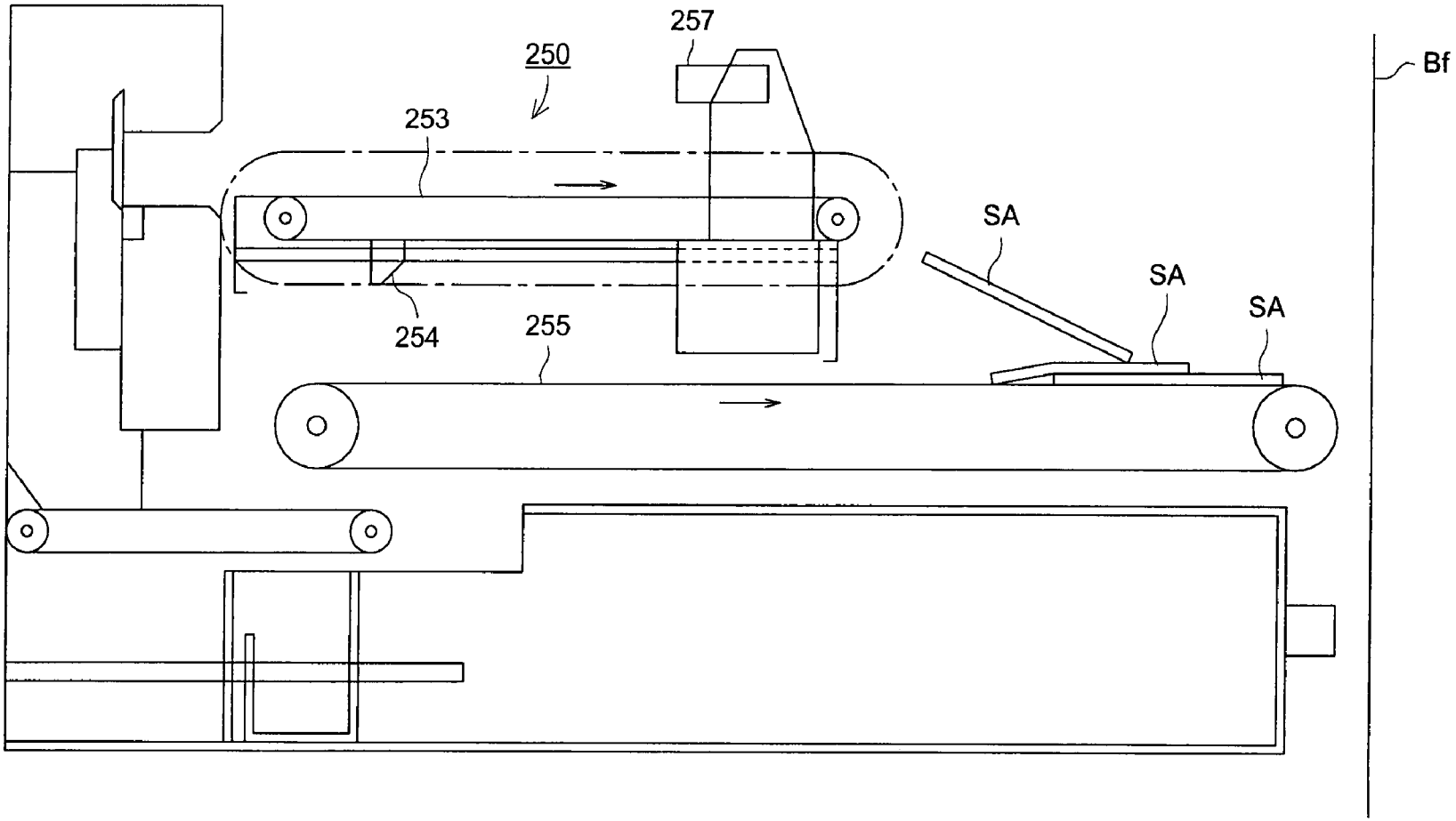
FIG. 23 is a cross-sectional view showing the process in which the trimmed booklet is discharged.

FIGS. 15 through 19 are cross-sectional views showing the process in which a center folded and saddle-stitched booklet SA is transported and carried into a trimming apparatus 280. FIGS. 20 and 21 are cross-sectional views showing the process in which a trimming apparatus 280 trims the edge of the booklet SA. FIGS. 22 and 23 are cross-sectional views showing the process in which the trimmed booklet SA is discharged.

Figure 15:
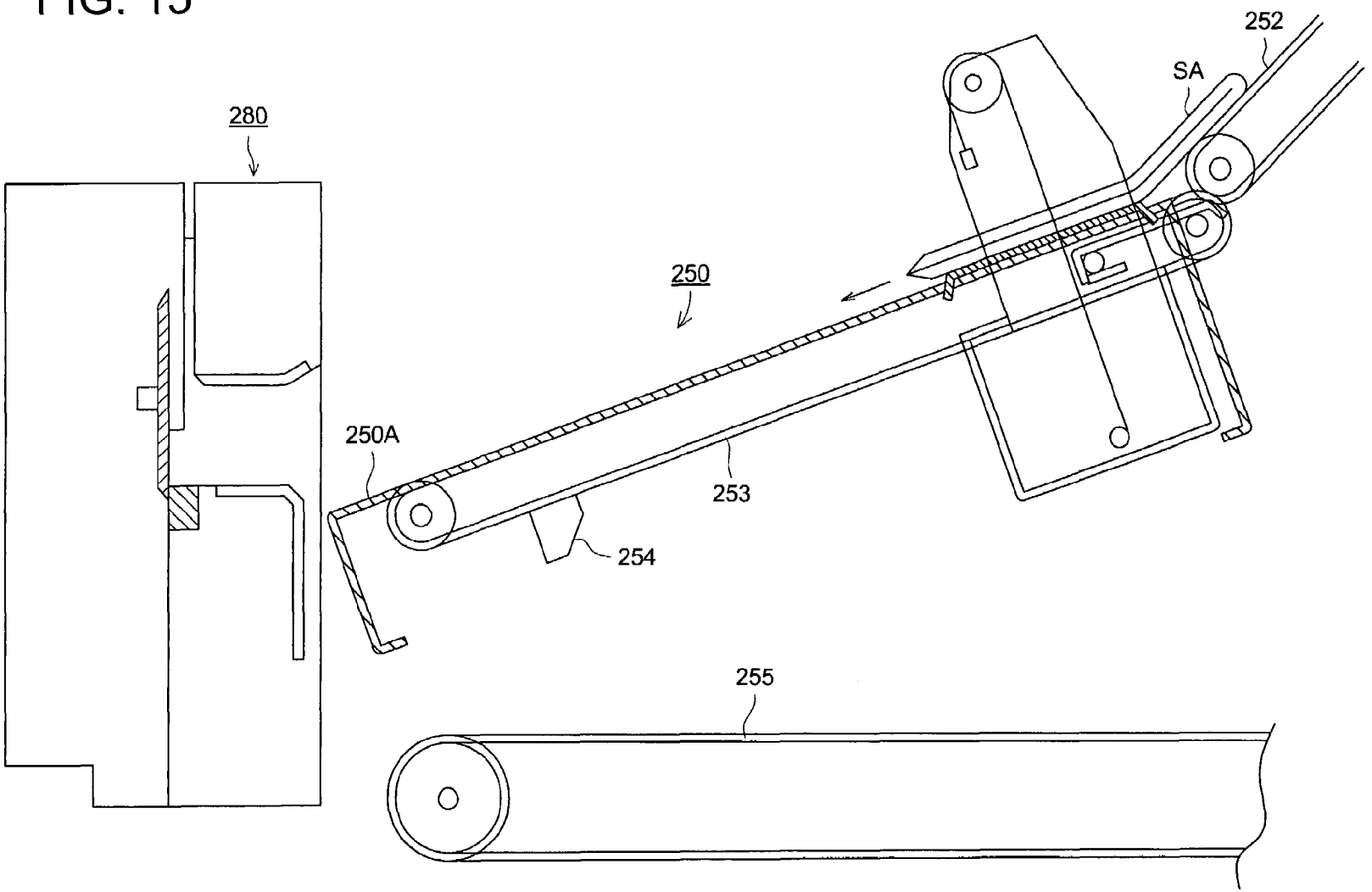
FIG. 15 is a cross-sectional view showing the process in which a center-folded and saddle-stitched booklet is transported and inserted into a trimming apparatus.
Figure 16:
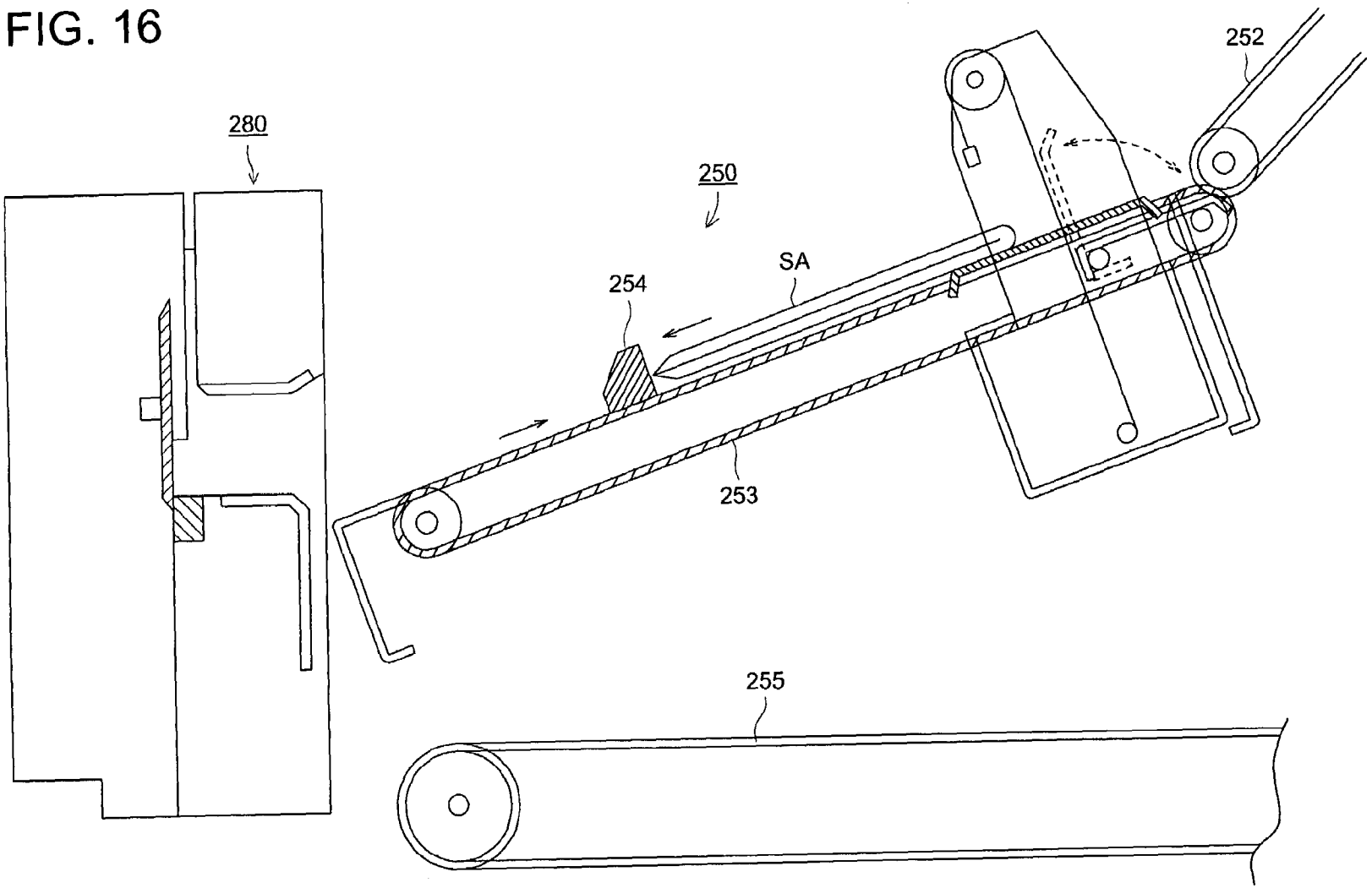
FIG. 16 is a cross-sectional view showing the process in which a booklet is sent to a trimming apparatus.
Figure 17:
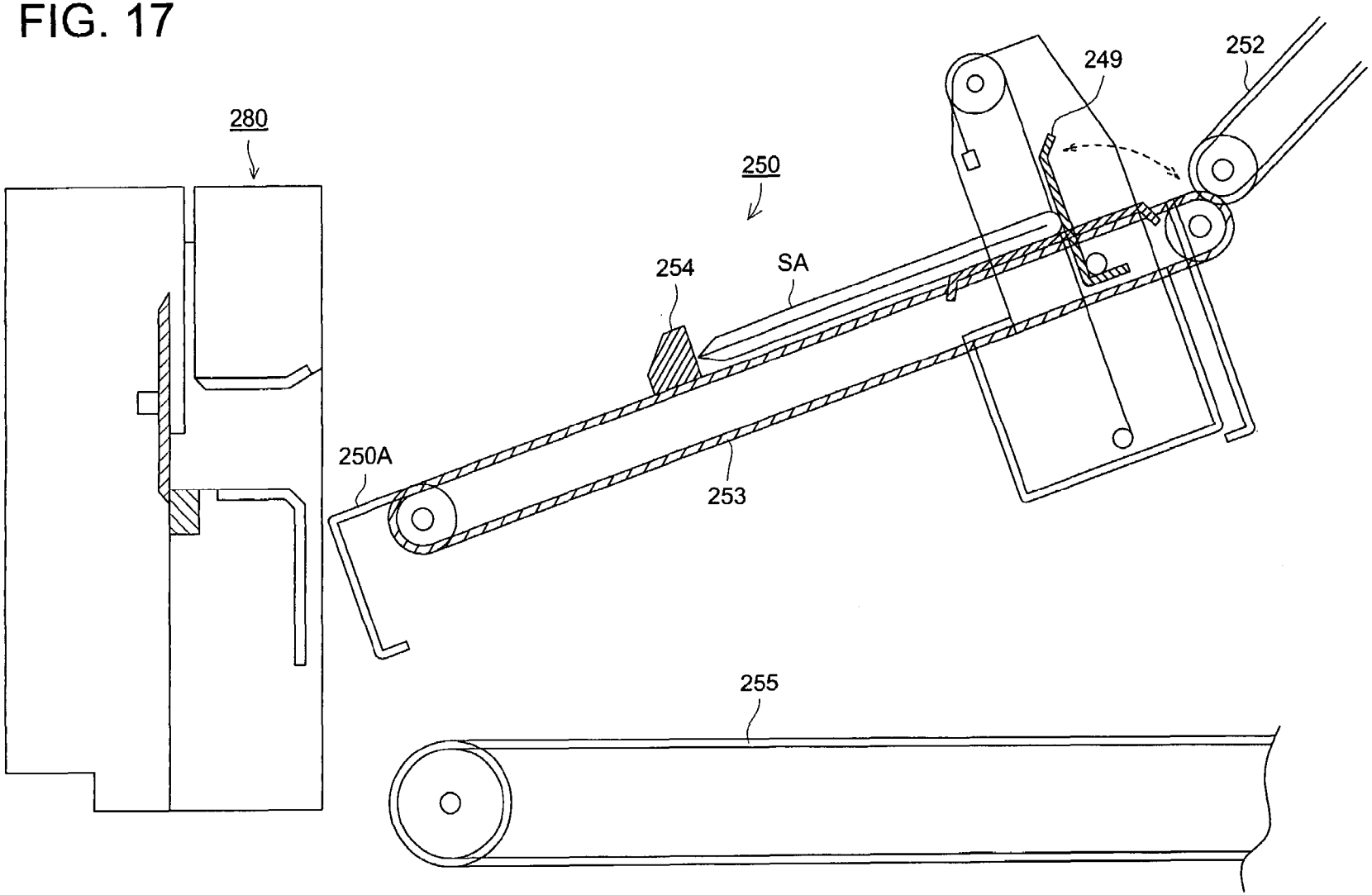
FIG. 17 is a cross-sectional view showing the process in which a booklet is sent to a trimming apparatus.

(1) A booklet SA which slides down onto the inclined transporting belt 252 is transported, with its edge leading, on the booklet placement board 250A which is held at an inclined position (see FIG. 15).

(2) The transporting belt 253 is rotated clockwise as shown in the drawing, and the contact member 254 advances to a prescribed position corresponding to the size of the sheet. The leading edge of the booklet SA which slides down onto the booklet placement board 250A abuts against the contact member 254 and stops (see FIG. 16). Wherein, since the booklet placement board 250A is kept at the inclined position, the posture of the booklet with respect to the contact member 254 is easily adjusted by using the own weight of the booklet.

(3) The booklet misalignment correcting means (booklet alignment means) consists of a reference alignment member 249 which can be raised and lowered, and a rotatable contact member 254. After the reference alignment member 249 has stood upright, the contact member 254 further advances in the direction indicated by the arrow, moves the leading edge of the booklet SA backward by contact-pressing it, and then abuts the trailing edge of the booklet SA against the elevated reference alignment member 249, and finally misalignment of the booklet SA is corrected (see FIG. 17).

Figure 18:
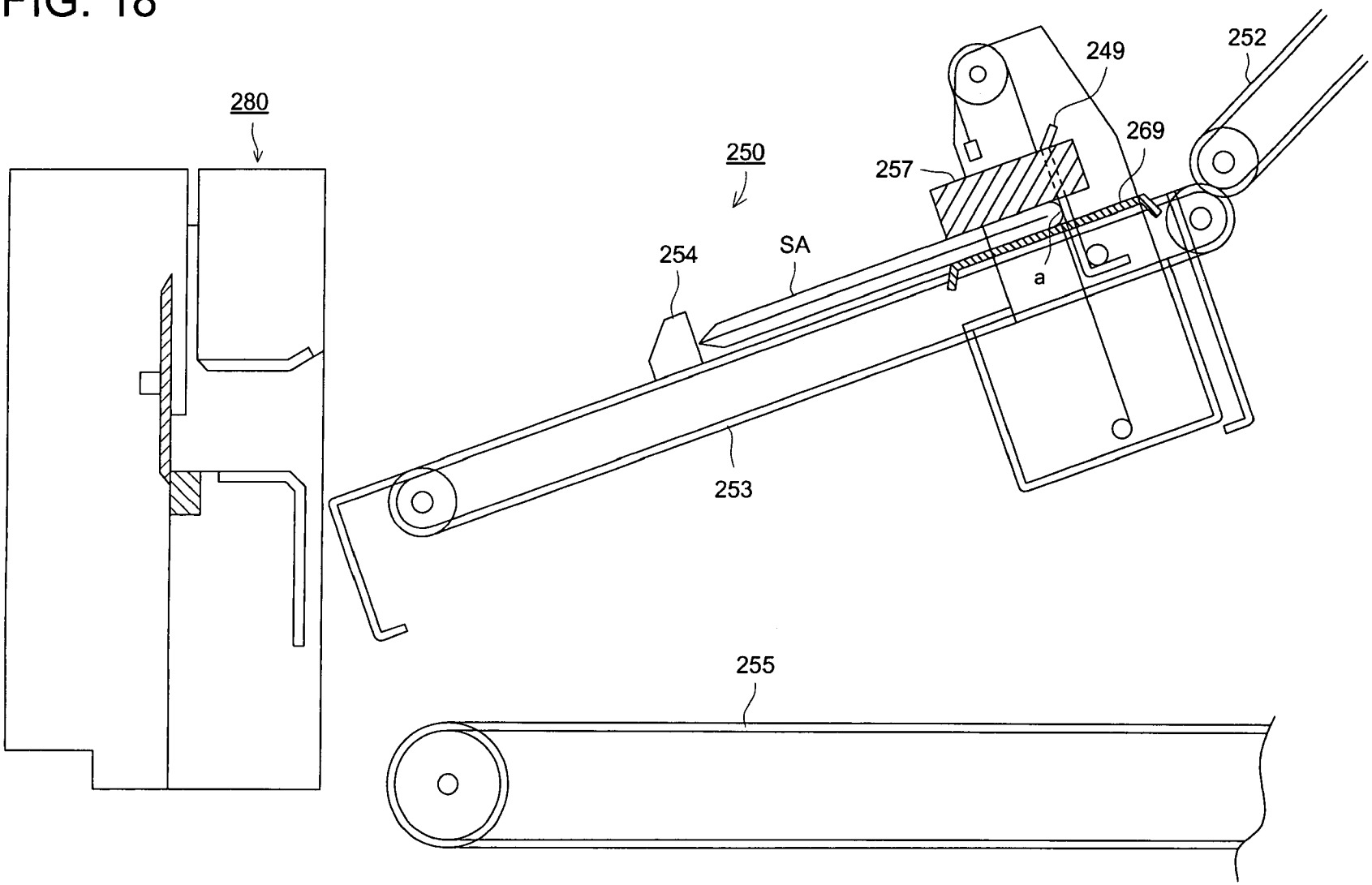
FIG. 18 is a cross-sectional view showing the process in which a booklet is sent to a trimming apparatus.

(4) A drive means shown in FIGS. 8 and 10 lowers a pressing plate 257, and the pressing plate 257 contact-presses and flattens the swollen portion in the vicinity of the fold "a" of the booklet SA which is loaded on the booklet supporting plate 269 (see FIG. 18). After the booklet SA has been contact-pressed, the rotation of the transporting belt 253 is reversed and the contact member 254 is returned to the initial position.

Figure 19:
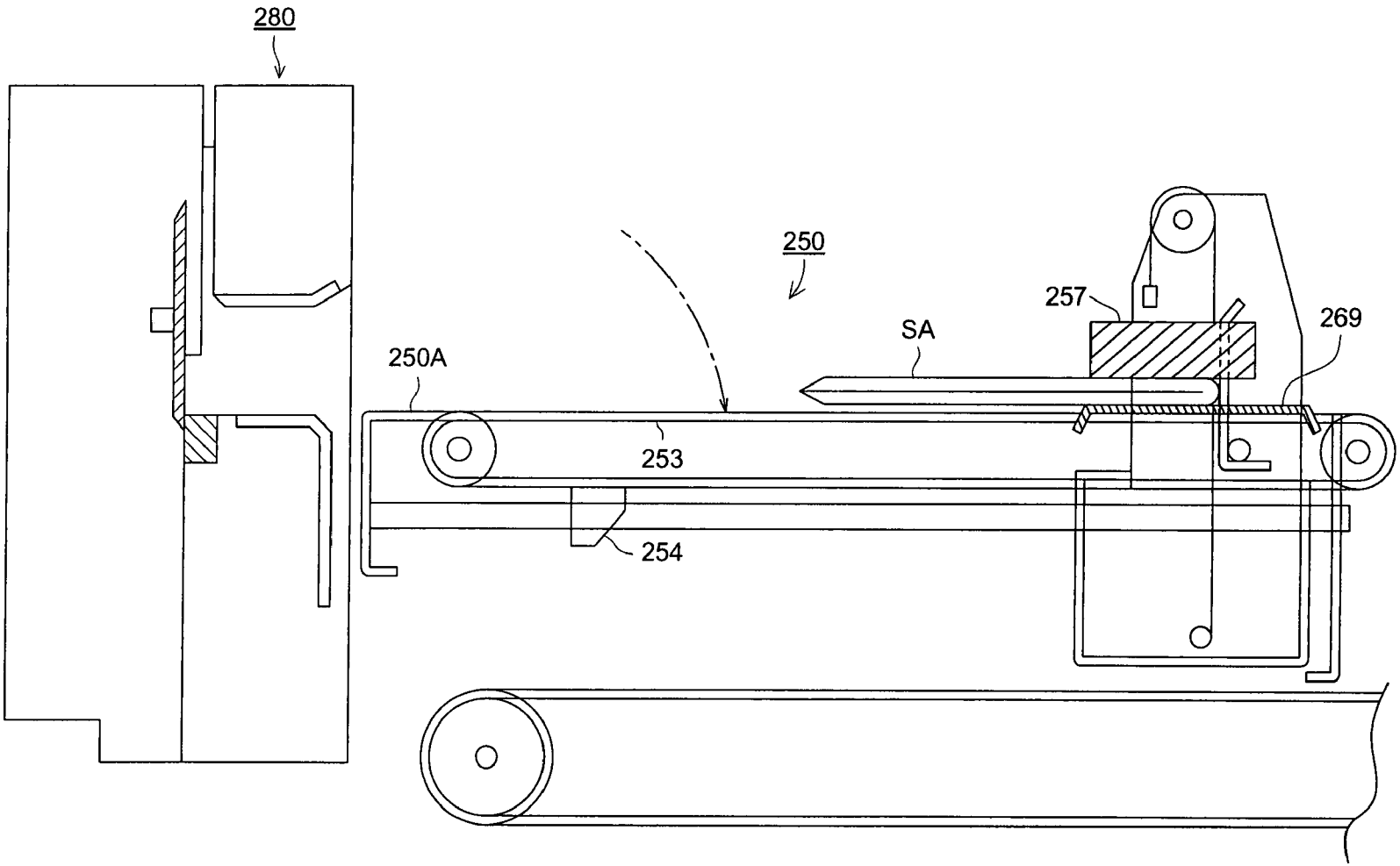
FIG. 19 is a cross-sectional view showing the process in which a booklet is sent to a trimming apparatus.

(5) The booklet transporting means 250 oscillates the booklet SA from the inclined position to a horizontal position while a contact-pressing means consisting of a pressing plate 257 and a booklet supporting plate 269 contact-presses and holds the vicinity of the booklet's fold "a" (see FIG. 19).

(6) While the pressing plate 257 and the booklet supporting plate 269 contact-press and holds the vicinity of the fold "a", the contact-pressing means (pressing unit) consisting of the pressing plate 257 and the booklet supporting plate 269 is moved to the left, as shown in the drawing, by means of a drive means shown in FIG. 9, thereby inserting the edge of the booklet SA into the opening 280A of the trimming apparatus 280 (see FIG. 20).

(7) The booklet SA inserted at a trimming position in the trimming apparatus 280 is trimmed by a rotating upper blade 281 and a fixed lower blade 282 while being flattened by the pressing plate 257 contact-pressing the vicinity of the fold and the booklet holding member 290 contact-pressing the vicinity of the edge (see FIG. 21).

(8) After the edge of the booklet has been trimmed, the pressing plate 257 and the booklet holding member 290 stop contact-pressing the booklet. Then, the transporting belt 253 rotates in the forward direction, the contact member 254 contact-presses the edge of the booklet SA, and then the booklet is transported on the booklet placement board 250A to be discharged (see FIG. 22).

(9) When the edge of the booklet SA passes the swiveling position of the contact member 254 in the vicinity of the right end of the transporting belt 253 as shown in the drawing, the booklet is pushed by the contact member 254 and ejected downward from the booklet transporting means 250. The booklet SA is ejected to the rotating discharge belt 255 from above, and then is placed on top of the upper surface of the preceding booklet SA in a cascaded state.

When a small number of small booklets SA are stacked, the booklets can be unloaded by opening a door on the front side Bf of the post-processing apparatus B (see FIG. 23).

(10) Generally, the degree of swell of the center-folded and saddle-stitched booklet SA differs according to the type of paper and the number of sheets the booklet contains. A booklet SA which has a large number of sheets easily becomes bulky. When such a thick booklet SA is transported by a transporting belt 253 and loaded on the discharge belt 255 after it has been trimmed, it may not be placed in a neat cascaded state because the thick booklet SA comes in sliding contact with a swollen portion of a preceding booklet SA stacked on the discharge belt 255, causing friction resistance.

Figure 24:
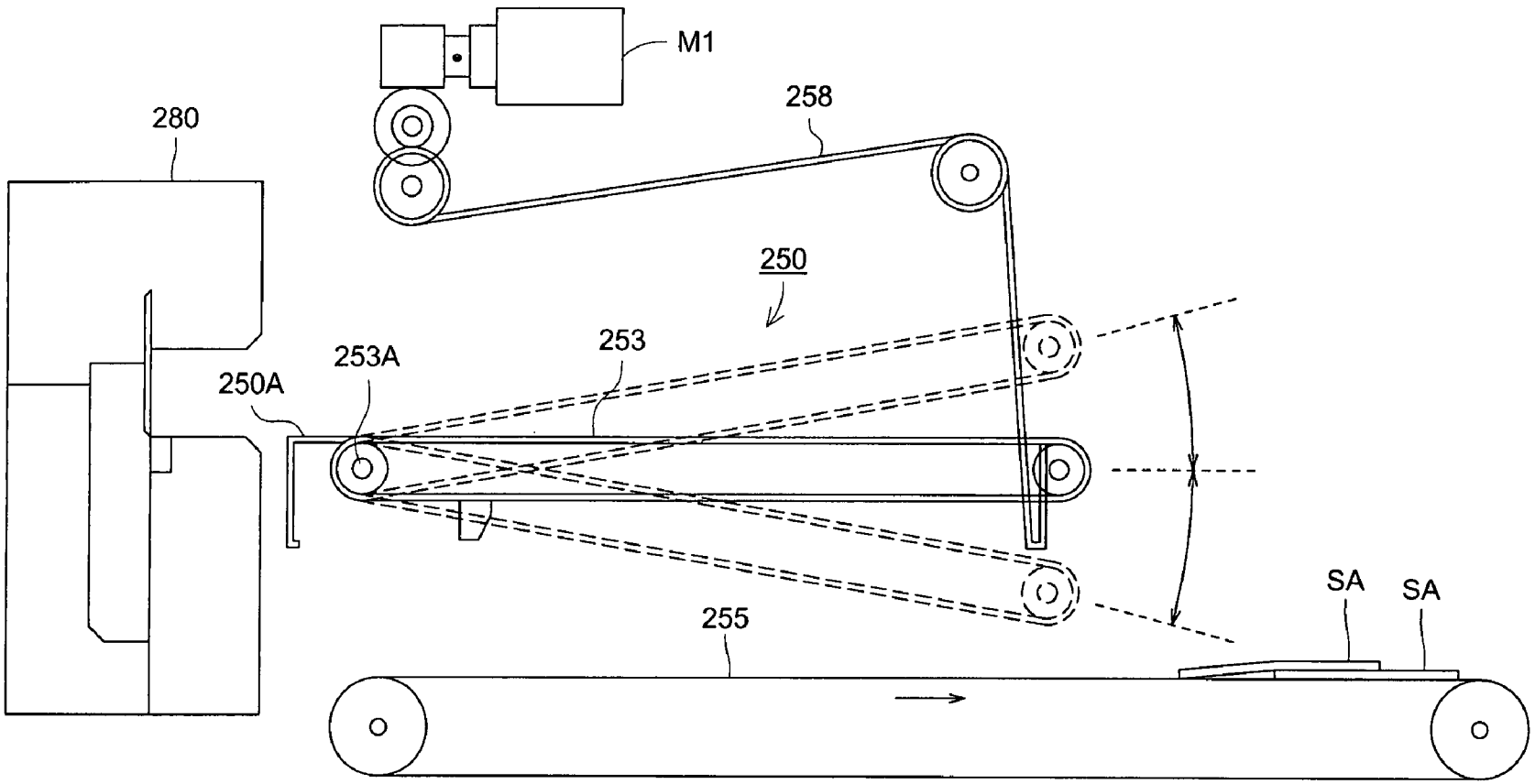
FIG. 24 is an explanatory drawing showing a variety of inclination angles of the booklet transporting means.

FIG. 24 is an explanatory drawing showing a variety of inclination angles of the booklet transporting means.

To change the angle, a lifting means, shown in FIG. 8, is used to wind up a wire 258 and lift the discharge side of the transporting portion of the booklet transporting means 250, right side in the drawing, around the drive roller rotating shaft 253A.

The booklet SA transported on the booklet transporting means 250 is ejected slightly above the horizontal position, as shown in FIG. 23, and placed on the discharge belt 255. Therefore, a subsequently ejected booklet SA is stacked from above on top of the preceding booklet SA in a neat cascaded state which is made possible because there is less friction resistance between the booklets.

When a booklet SA contains a small number of sheets, the discharge side of the booklet transporting means 250, right side in the drawing, is lowered around the drive roller rotating shaft 253A.

The lifting and lowering of the booklet transporting means 250 is controlled by the operating portion 9 according to type of paper, the number of sheets and the size of sheets. Further it is also preferable to lift the booklet transporting means 250 according to progress in number of the booklets. By this, collision is effectively prevented between the already ejected booklet and the booklet to be subsequently ejected, and hard rubbing between the booklets can also be prevented to ensure good alignment of the ejected booklets.

(11) FIG. 25(*a*) is a cross-sectional view showing the state in which the discharge belt 255 is stored in the post-processing apparatus B. FIG. 25(*b*) is a cross-sectional view showing the state in which the discharge belt 255 is pulled out toward the front side Bf of the post-processing apparatus B.

The discharge belt 255 can be pulled out toward the front side Bf of the post-processing apparatus B. That is, by grasping a portion of a frame body, not shown, which supports the discharge belt 255 and pulling it out, the frame body comes in sliding contact with a sliding rail 295 supported by the main body of the post-processing apparatus B and then moves away.

As the frame body moves, the drive roller 255A which winds around the discharge belt 255 moves together, and the pulley 245 mounted to the rotating shaft of the drive roller 255A also moves. Even though the drive roller 255A moves, the motor M5 rotates the wire W2 which winds around the pulley 245, thereby rotating the drive roller 255A.

Figure 26:
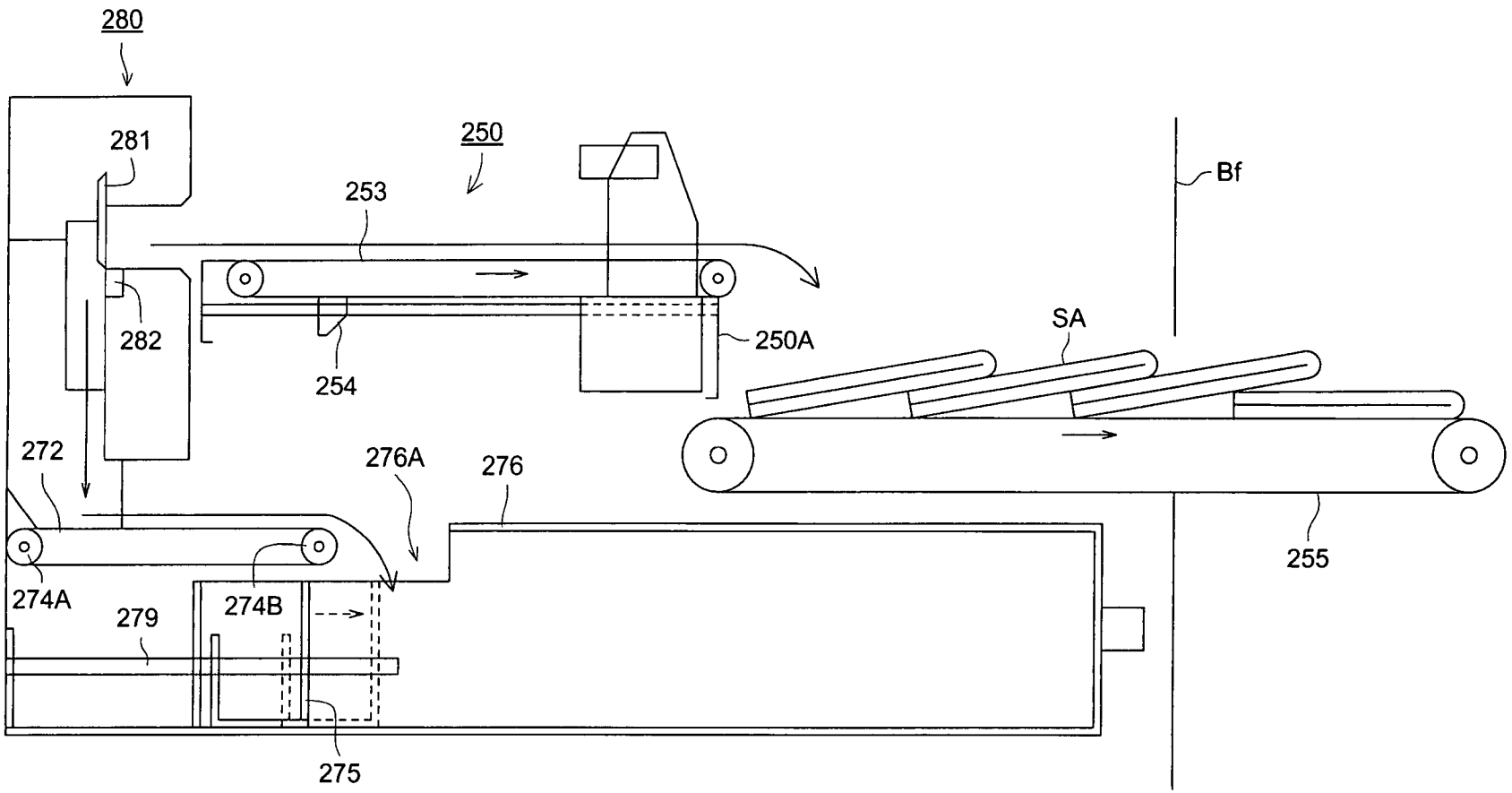
FIG. 26 is a cross-sectional view showing the state in which booklets are stacked on the discharge belt.

(12) FIG. 26 is a cross-sectional view showing the state in which booklets SA are stacked on the discharge belt 255. A booklet SA ejected from the transporting belt 253 located above is placed on the discharge belt 255 located below. The rotating discharge belt 255 one by one receives booklets SA ejected from the transporting belt 253, stacks them in a cascaded state, and transports them toward the front side Bf of the post-processing apparatus B. An operator can take out transported booklets SA one by one. Accordingly, it is possible to pull out the discharge belt 255 further than the front side Bf of the post-processing apparatus B and make it rotatable.

(13) As shown in FIG. 26, trimmed scraps which dropped from the edge of the booklet SA trimmed by both the rotating upper blade 281 and the fixed lower blade 282 of the trimming apparatus 280 are loaded on the rotating trimmed-scrap transporting belt 272 located below by means of a motor M5 and a drive means shown in FIG. 14. The trimmed scraps are then transported to the right as shown in the drawing, discharged and drop in the vicinity of the pulley 274B, and then loaded into the opening 276A of the trimmed-scrap container 276 below.

The motor M5 and a drive means, as shown in FIG. 14, move the transfer member 275 back and forth along the guide bar 279. Trimmed scraps which have accumulated in the vicinity of the opening 276A of the trimmed-scrap container 276 are transported to the right of the transfer member 275 as indicated by the broken line in the drawing, and then successively transported to the inner part pf the trimmed-scrap container 276. When a sensor PS8 detects that the trimmed-scrap container 276 has been filled with scraps, it stops driving the post-processing apparatus B or activates an alarm. An operator replaces the trimmed-scrap container 276 with a new one, or discards trimmed scraps contained in the trimmed-scrap container 276 and continuously uses the same trimmed-scrap container 276.

According to the post-processing apparatus in the embodiment of the present invention, when the booklet is transported after the processing of the center-folding and the processing of saddle-stitching to the trimming apparatus, since skew of the booklet is corrected, high quality of trimming can be achieved. Further since the booklet is inserted into the opening of the trimming apparatus while it is press contacted by the contact-pressing member, it is adequately inserted to result in high quality of trimming. Further more, since the vicinity of the booklet edge is press-contacted for long period, bulge of the booklet is suppressed and the trimming is conducted while the booklet is in flattened condition, this results in high finishing quality of the booklet.

Furthermore, according to the post-processing apparatus in the embodiment of the present invention, the transporting plane angle of the booklet transporting unit (means) is variable, the transportation is highly stable at the time of receiving the booklet, inserting the booklet into the opening of the trimming apparatus, and ejecting the booklet after the trimming. And, by making the transporting plane angle of the transporting unit variable according to the kind, number and the size of the sheets constituting the booklet, high stability can be achieved at the time of booklet ejection.

Furthermore, according to the image forming system in the embodiment of the present invention, after conducting a high-speed image forming, one-side recording, double-side recording, page collating and-the like, the post-processing apparatus conducts a center folding processing and a saddle stitching processing, after that the trimming section can perform an exact and high-speed trimming processing. Therefore, the image forming system can achieve a high-speed and high productivity image forming.

In an embodiment according to the present invention, a post-processing apparatus which is connected to a copier's main body and has center folding and saddle stitching functions has been explained. However, the present invention can apply to a post-processing apparatus which first saddle-stitches a booklet and then center-folds it. It is also possible to selectively connect a post-processing apparatus having a paper folding apparatus according to the present invention to a book binding apparatus connected to a shortrun printer in order to consistently conduct multi-purpose, multi-functional post-processing.

Furthermore, the present invention can also apply to a post-processing apparatus which is connected to an image-forming apparatus, such as a shortrun printer, printer, facsimile, compound machine, ect.

Moreover, it is also possible to configure a stand-alone post-processing apparatus which is independent of an image-forming apparatus and thereby conducts a variety of folding processes.

What is claimed is:

1. An image forming system provided with a post-processing section for conducting a post-processing of a sheet, the image forming system comprising:

an image forming section for forming an image on the sheet, such that the sheet is an image-recorded sheet;

a plurality of post-processing sections arranged at vertically different positions with each other;

a transporting unit adjustable of the transporting plane angle so that the image-recorded sheet is possible to be delivered and received between the plurality of post-processing positions; and an oscillating mechanism for oscillating the transporting unit to change a transporting plane angle of the transporting unit;

wherein, the oscillating mechanism oscillates the transporting unit to arrange different from each other, a first transporting plane angle at the time when the transporting unit receives the booklet from the first post-processing section provided at a higher position, a second transporting plane angle at the time when the transporting unit conveys the image-recorded sheet to a second post-processing section positioned at a lower position, and a third transporting plane angle at the time when the transporting unit carries out the image-recorded sheet processed by the second post-processing section.

2. A post-processing apparatus for processing an image-recorded sheet, comprising:

a plurality of post-processing sections arranged at vertically different positions with each other;

a transporting unit adjustable of the transporting plane angle so that the image-recorded sheet is possible to be delivered and received between the plurality of post-processing positions;

an oscillating mechanism for oscillating the transporting unit to change a transporting plane angle of the transporting unit;

wherein, the oscillating mechanism oscillates the transporting unit to arrange different from each other, a first transporting plane angle at the time when the transporting unit receives the booklet from the first post-processing section provided at a higher position, a second transporting plane angle at the time when the transporting unit conveys the image-recorded sheet to a second post-processing section positioned at a lower position, and a third transporting plane angle at the time when the transporting unit carries out the image-recorded sheet processed by the second post-processing section.

3. The post-processing apparatus of claim 2:

wherein, the plurality of post-processing sections include a stitching section, for stitching a plurality of image-recorded sheets, including the image-recorded sheet, arranged at a higher position and a trimming section, for trimming an edge of a booklet comprising the stitched plurality of image-recorded sheets, arranged at a lower position;

wherein, the oscillating mechanism oscillates the transporting unit within a time period when the image-recorded sheet exists on the transporting unit so that the image-recorded sheet is possible to be delivered and received between positions of the plurality of post-processing sections.

4. The post-processing apparatus of claim 3, wherein the oscillating mechanism raises an image-recorded sheet receiving side of the transporting unit when the transporting unit receives the image-recorded sheet from the stitching section arranged at the higher position, and lowers the image-recorded sheet receiving side of the transporting unit when the transporting unit delivers the image-recorded sheet to the trimming section arranged at the lower position.

5. The post-processing apparatus of claim 3, further comprising a skew correcting unit on the transporting unit for correcting a skew of the image-recorded sheet, wherein the image-recorded sheet transported by the transporting unit is formed to be the booklet stitched by the stitching section, and wherein the booklet is delivered to the trimming section after the skew of the booklet is corrected by the skew correcting unit in a condition that the transporting plane of the transporting unit is inclined by the oscillating mechanism.

6. The post-processing apparatus of claim 5, further comprising:

a folding section for folding the image-recorded sheet; and a contact-pressing member for pressing the booklet at a vicinity of a folding line;

wherein, after the folding section has conducted a center-folding processing and the stitching section has conducted a stitching processing to form the booklet and after the skew correcting section has corrected the skew of the booklet, the contact-pressing member presses the booklet at the vicinity of the folding line, and an edge portion of the booklet is transported to the trimming section while the contact-pressing member keeps pressing the booklet.

7. The post-processing apparatus of claim 6, further comprising a driving unit for moving the contact-pressing member to the trimming section while the contact-pressing member keeps pressing the booklet at the vicinity of the folding line.

8. The post-processing apparatus of claim 2, wherein the oscillating mechanism oscillates the transporting unit to vary the third transporting plane angle according to the image-recorded sheet.

9. The post-processing apparatus of claim 8, wherein the oscillating mechanism oscillates the transporting unit to vary the third transporting plane angle according to at least one of a kind, a number and a size of the image-recorded sheet.

10. The post-processing apparatus of claim 8, wherein the oscillating mechanism oscillates the transporting unit to vary the third transporting plane angle according to a progress in a number of the plurality of image-recorded sheets, which is continuously carried out from the transporting unit.

11. The post-processing apparatus of claim 2, further comprising a folding section for folding the image-recorded sheet at upstream of the transporting unit in a transporting direction of the image-recorded sheet.

12. The post-processing apparatus of claim 2, further comprising a discharging unit capable of stacking the image-recorded sheet carried out from the transporting unit and capable of moving to shift a stacking position of the image-recorded sheet.

13. The post-processing apparatus of claim 2, further comprising:

a folding section for folding the image-recorded sheet; and a discharging unit capable of stacking a booklet comprising the plurality of image-recorded sheets having been folded, stitched, and carried out from the transporting unit, and capable of moving to shift a stacking position of the booklet;

wherein the oscillating mechanism oscillates the transporting unit to vary the transporting plane angle according to at least one of a kind, a number and a size of the image-recorded sheet forming the booklet, or according to a progress in a number of booklets, including the booklet, the booklets being continuously carried out from the transporting unit.

* * * * *